US010745782B2

(12) United States Patent
Wolverton et al.

(10) Patent No.: US 10,745,782 B2
(45) Date of Patent: Aug. 18, 2020

(54) MAGNESIUM ALLOYS HAVING LONG-PERIOD STACKING ORDER PHASES

(71) Applicant: Northwestern University, Evanston, IL (US)

(72) Inventors: Christopher M. Wolverton, Evanston, IL (US); James E. Saal, Chicago, IL (US)

(73) Assignee: Northwestern University, Evanston, IL (US)

( * ) Notice: Subject to any disclaimer, the term of this patent is extended or adjusted under 35 U.S.C. 154(b) by 105 days.

(21) Appl. No.: 15/981,078

(22) Filed: May 16, 2018

(65) Prior Publication Data

US 2018/0265949 A1 Sep. 20, 2018

Related U.S. Application Data

(62) Division of application No. 14/497,286, filed on Sep. 25, 2014, now Pat. No. 9,994,935.

(60) Provisional application No. 61/882,984, filed on Sep. 26, 2013.

(51) Int. Cl.

| | |
|---|---|
| ***C22C 23/06*** | (2006.01) |
| ***C22C 23/00*** | (2006.01) |
| ***C22C 23/02*** | (2006.01) |
| ***C22C 23/04*** | (2006.01) |

(52) U.S. Cl.

CPC ..... *C22C 23/06* (2013.01); *C22C 23/00* (2013.01); *C22C 23/02* (2013.01); *C22C 23/04* (2013.01)

(58) Field of Classification Search

CPC ..... C22C 23/00; C22C 23/02; C22C 23/04; C22C 23/06

USPC ..... 420/405

See application file for complete search history.

(56) References Cited

FOREIGN PATENT DOCUMENTS

JP 2002256370 A * 9/2002
JP 2012224909 A * 11/2012

OTHER PUBLICATIONS

NPL: on-line translation of JP 20022563370 A, Sep. 2002 (Year: 2002).*

NPL: on-line translation of JP 2012224909 A, Nov. 2012 (Year: 2012).*

NPL-1: Egusa et al, The structure of LPSO Mg—Zn—Re phase with extended non-stoichiometry ranges, Acta Materialia 60 (2012) pp. 166-178, thereafter NPL-1) (Year: 2012).*

* cited by examiner

*Primary Examiner* — Jie Yang

(74) *Attorney, Agent, or Firm* — Bell & Manninng, LLC

(57) ABSTRACT

Magnesium alloys comprising a long period stacking order (LPSO) phase having an 14H-i or an 18R-i structure are provided. The alloys comprise magnesium as a majority element, a first alloying element that is larger than magnesium and a second alloying element that is smaller than magnesium.

6 Claims, 6 Drawing Sheets

MAGNESIUM ALLOYS HAVING LONG-PERIOD STACKING ORDER PHASES

CROSS-REFERENCE TO RELATED APPLICATIONS

The present application is a divisional application that claims priority to U.S. patent application Ser. No. 14/497,286 that was filed Sep. 25, 2014, which claims priority to U.S. provisional patent application 61/882,984 that was filed Sep. 26, 2013, the entire contents of which are hereby incorporated by reference.

BACKGROUND

Mg-based alloys are often considered potential lightweight structural alloys for transportation applications in efforts to improve efficiency. However, poor mechanical strength and ductility have long been impediments to wide industrial use of Mg alloys. Some Mg-based alloys have been observed to form a ternary precipitate exhibiting order with long periods along the c-axis. Referred to as long period stacking ordered (LPSO) structures, these precipitates, and their resulting high strength, have since been observed in a variety of ternary Mg systems. However, LPSO systems typically contain at least 1 at. % rare earth (RE) elements, making such alloys prohibitively expensive for high-volume industrial applications.

SUMMARY

Magnesium alloys comprising a long period stacking order (LPSO) phase are provided. The alloys comprise magnesium as a majority element, a first alloying element that is larger than magnesium and a second alloying element that is smaller than magnesium. In the present alloys, the first alloying element can be a rare earth (RE) element, a non-rare earth (non-RE) element, or a mixture of the two.

Some embodiments of the magnesium alloys comprise a long period stacking order structural phase having a 14H-i structure with a $Mg_{71}X^L{}_8X^S{}_6$ composition or having a 18R-i structure with a $Mg_{59}X^L{}_8X^S{}_6$ composition, wherein $X^L$ comprises a non-rare earth alloying element selected from Ca, Th, Sr and Pa and $X^S$ comprises a second alloying element selected from Zn, Al, Cu, Ni and Co. In these structures, if $X^L$ is Ca, $X^S$ is Zn, Al or Cu; if $X^L$ is Sr, $X^S$ is Zn; and if $X^L$ is Pa, $X^S$ is Co. Included in these embodiments are magnesium alloys that further comprise a third alloying element, wherein the third alloying element is a rare earth element.

Some embodiments of the magnesium alloys comprise a long period stacking order structural phase having a 14H-i structure with a $Mg_{71}X^L{}_8X^S{}_6$ composition or having a 18R-i structure with a $Mg_{59}X^L{}_8X^S{}_6$ composition, wherein $X^L$ comprises a rare earth alloying element selected from Sc, Y, La, Ce, Pr, Nd, Pm, Sm, Eu, Gd, Tb, Dy, Ho, Er, Tm, Yb and Lu and $X^S$ is selected from Al, Zn, Cu, Ni, and Co, and further wherein if $X^S$ is Al, $X^L$ is not Gd; if $X^S$ is Zn, $X^L$ is not Y, Gd, Tb, Dy, Ho, Er, or Tm; if $X^S$ is Cu, $X^L$ is not Y, La, Ce, Gd, Tb, Dy, Ho, Er, or Tm; if $X^S$ is Ni, $X^L$ is not Y, Ce, Gd, Tb, Dy, Ho, Er, or Tm; and if $X^S$ is Co, $X^L$ is not Y, Ce, Eu, Gd, Tb, Dy, Ho, Er, Tm or Yb.

Other principal features and advantages of the invention will become apparent to those skilled in the art upon review of the following drawings, the detailed description, and the appended claims.

BRIEF DESCRIPTION OF THE DRAWINGS

Illustrative embodiments of the invention will hereafter be described.

DETAILED DESCRIPTION

Figure 1:
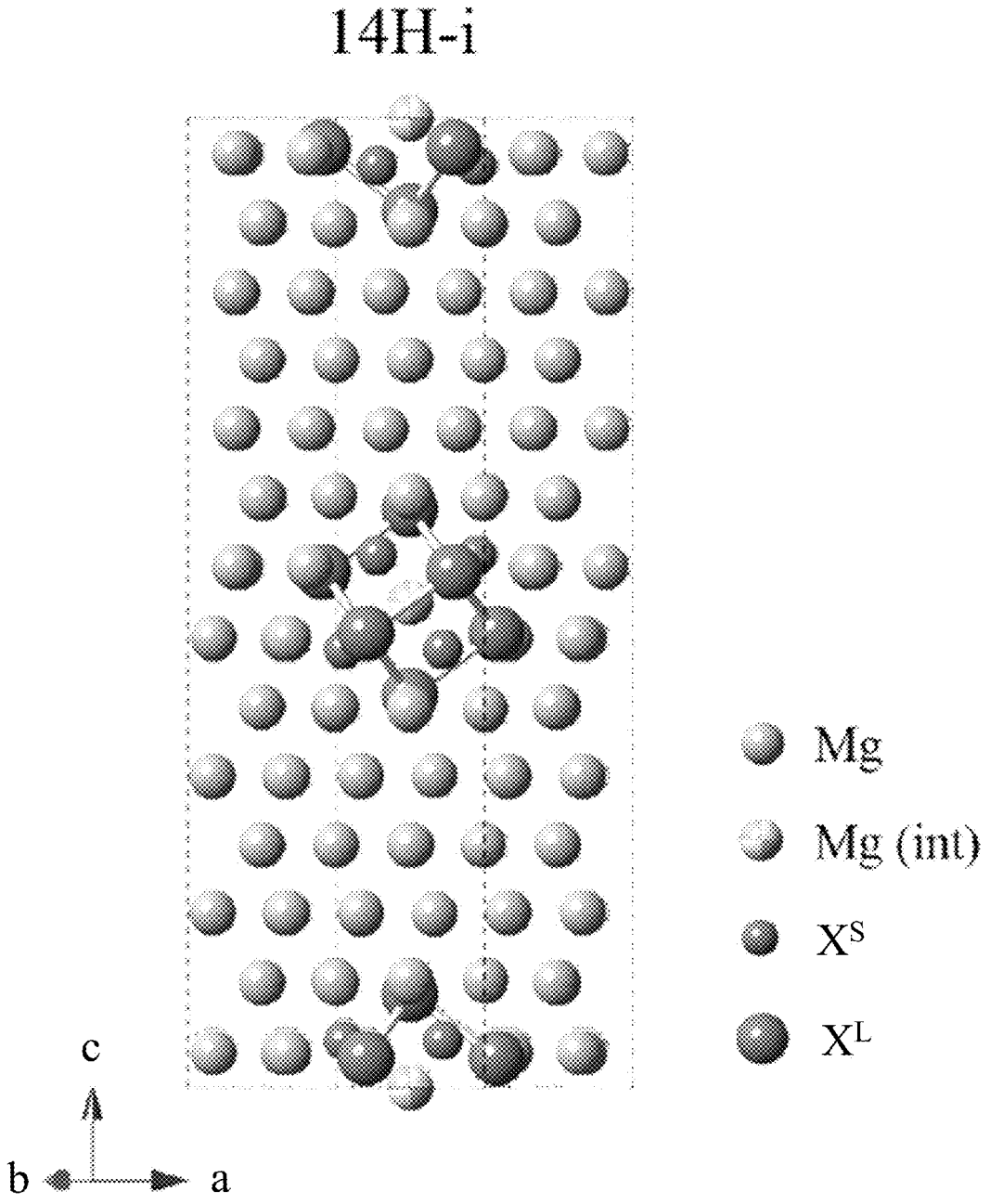
FIG. 1: The $Mg_{71}X_8{}^LX_6{}^S$ 14H-i LPSO crystal structure. A full $X_6{}^SX_8{}^L$ $L1_2$-arranged cluster can be seen in the middle of the cell with a Mg interstitial site at the center. The origin has been shifted by 0.5, 0.5, 0 with respect to coordinates in Table 1.

Magnesium alloys comprising a long period stacking order (LPSO) phase are provided. The alloys comprise magnesium as a majority element, a first alloying element that is larger than magnesium (denoted $X^L$) and a second alloying element that is smaller than magnesium (denoted $X^S$). The LPSO phases in the alloys include those having the structure 14H-i with the composition $Mg_{71}X^L{}_8X^S{}_6$ and the structure 18R-i with the composition $Mg_{59}X^L{}_8X^S{}_6$.

$X^L$ can be a rare earth (RE) element, a non-rare earth element (non-RE), or a mixture of the two. However, some embodiments of the alloys are free of RE elements. The RE elements are selected from Group III and the lanthanide series of the periodic table.

Non-RE elements include actinides and elements from Groups I, II, IV, V and VI of the periodic table. Mg alloys in which $X^L$ comprises, consists of or consists essentially of non-RE elements can be significantly less expensive to produce than Mg alloys in which $X^L$ is an RE element. As a result, such alloys are well-suited for use in high volume industrial applications. Examples of non-RE elements that can be used as $X^L$ elements include Ca, Th, Sr and Pa. Of these, Ca and Sr may find the broadest range of applications because they are not radioactive.

$X^S$ is a metal element and can be, for example, a transition metal or a Group II metal. Examples of transition metals that can be used as $X^S$ elements are first row transition metals, such as Zn, Cu, Ni and Co. Al is an example of a Group II metal that can be used as an $X^S$ element.

In some embodiments the Mg alloys are ternary alloys that can be represented by the general formula Mg—$X^L$—$X^S$, where $X^L$ represents a single element. However, the Mg alloys can also be higher order alloys, such as quaternary alloys, wherein $X^L$ in the preceding formula represents a mixture of elements. Alloys of this type can be represented by the formula Mg—$X^L1$-$X^L2$-$X^S$. In some such alloys, one $X^L$ element (e.g., $X^L1$) is a RE element and the other $X^L$ element (e.g., $X^L2$) is a non-RE element. The mass ratio of RE to non-RE in the alloys can vary broadly. In various embodiments this mass ratio is in the range from about 0.1:99.9 to 99.9 to 0.1. This include embodiments in which the mass ratio is in the range from about 1:99 to 99:1 and further includes embodiments in which it is in the range from about 1:9 to 9:1.

Specific examples of ternary Mg alloys in which $X^L$ is a non-RE element that form an LPSO phase include Mg—Ca—Al; Mg—Ca—Zn; Mg—Ca—Cu; Mg—Th—Al; Mg—Th—Zn; Mg—Th—Cu; Mg—Th—Ni; Mg—Th—Co; Mg—Sr—Zn and Mg—Pa—Co alloys. Specific examples of ternary Mg alloys in which $X^L$ is an RE element that form an LPSO phase include Mg—(Y, Pm, Sm, Tb, Dy, Ho, Er, Tm or Lu)—Al; Mg—(Zn, Pm, Sm or Lu)—Zn; Mg—(Sc or Lu)—Cu; Mg—(Sc, Pm, Sm or Lu)—Ni; and Mg—(Pm or Lu)—Co alloys.

In the Mg alloys, Mg makes up the substantially majority of the alloy, typically present in an amount of about 80 atomic percent (at. %) or greater, 90 at. % or greater, or 95 at. % or greater. The $X^L$ and $X^S$ elements together typically make up no more than about 10 at. %, with each typically being present in an amount of from about 0.1 to 9.9 at. %. This includes embodiments in which $X^L$ and $X^S$ are each present in an amount from about 1 to about 5 at. % in the alloy.

The LPSO phase present in the alloy is a ternary precipitate with a long period stacking ordered structure. An LPSO phase with the 14H-I structure is illustrated in FIG. 1 for an $Mg_{71}X_8{}^LX_6{}^S$ 14H-i LPSO crystal structure. A description of LPSO phases can be found in Abe et al., *Acta Materialia* 60 (2012) 166-178. The presence of an LPSO phase in an Mg alloy can be determined using X-ray diffractometry (XRD), scanning electron microscopy (SEM) and transmission electron microscopy (TEM) as described, for example, in Yamasaki et al., *Materials Transactions,* 48 (2007) 2986-2992.

The Mg alloys comprising an LPSO phase can be produced by the extrusion of cast ingots or by rapidly solidified powder metallurgy. Descriptions of melting and casting techniques for the production of Mg alloys having LPSO phases are described in U.S. Pat. Nos. 8,333,924 and 8,394,211 and in Kawamura et al., *Materials Transactions*, Vol. 48, No. 11 (2007) pp. 2986 to 2992. In one method of producing the alloys a master ingot is formed by melting the pure elements in an inert environment followed by casting the resulting melt into a mold. A heat treatment may then be carried out before cooling and solidifying the melt. The resulting ingot comprising the LPSO phase may comprise various other phases.

EXAMPLE

This example describes the use of DFT calculations to predict the stability of LPSO structures in LPSO-forming ternary system to examine the effect of chemistry on LPSO stability. The example begins with an exploration of the thermodynamic stability of the interstitial LPSO structure model with DFT in detail for the Mg—Y—Zn system. The stability of the interstitial LPSO structure is then systematically examined in 85 RE-containing Mg—$X^L$—$X^S$ ternary systems, for $X^L$=RE (Sc, Y, La—Lu) and $X^S$=Zn, Al, Cu, Co, Ni. From these results, the validity of previously proposed rules for LPSO forming systems was tested, including the effect of the size of the $X^L$ element and the mixing energy between Mg and $X^L$ on the FCC lattice. These design rules were then used to predict several candidate non-RE $X^L$ elements that may also form LPSO structures, which were then calculated with DFT. These calculations, indicate that $X^L$=Ca, Sr, Pa and Th are LPSO forming elements in Mg alloys.

Methodology

DFT calculations were performed with the Vienna Ab-initio Simulation Package (VASP), employing the projected augmented wave method potentials and the exchange and correlation functional of Perdew, Burke, and Ernzerhof. (See, G. Kresse, J. Furthmuller, Physical Review B 54 (1996) 11169; G. Kresse, J. Furthmuller, Computational Materials Science 6 (1996) 15-50; G. Kresse, D. Joubert, Physical Review B 59 (1999) 1758-1775 and J. P. Perdew, K. Burke, M. Ernzerhof, Physical Review Letters 77 (1996) 3865.) All degrees of freedom for the crystal structures were relaxed, including volume, cell shape, and internal atomic coordinates, to determine the OK energetic ground state structure. An energy cutoff of 520 eV and gamma-centered k-point meshes of around 8000 k-points per reciprocal atom were used in the relaxation. k-space integration was performed by the first-order Methfessel-Paxton approach with a smearing width of 0.2 eV during structural relaxation and then by the tetrahedron method with Bloechl corrections during a final, static calculation for accurate total energy. The f-electrons of the lanthanide elements were treated as core electrons, an approximation that has shown to produce accurate thermodynamic properties for lanthanide-containing structures (See, M. Gao, A. Rollett, M. Widom, Physical Review B 75 (2007) 174120; Z. Mao, D. N. Seidman, C. Wolverton, Acta Materialia 59 (2011) 3659-3666; J. Saal, C. Wolverton, Acta Materialia 60 (2012) 5151-5159 and A. Issa, J. Saal, C. Wolverton Submitted (2013).) Calculations for systems containing Co and Ni were spin polarized with an initialized ferromagnetic structure.

For an LPSO structure to be thermodynamically stable, it must be stable with respect to every combination of unary, binary, and ternary phases in its respective ternary system. The thermo dynamic stability of an LPSO structure, $\Delta E_{stab}$ (LPSO), was defined by:

$$\Delta E_{stab}(\text{LPSO})=E(\text{LPSO})-\Sigma_i N_i \mu_i \quad (1)$$

where E(x) is the DFT predicted total energy of structure x, $N_i$ is the amount of element i, and $\mu_i$ is the chemical potential of element i. To determine the set of $\mu_i$ chemical potentials, the following two facts were employed: first, for a system in equilibrium, the chemical potential of each element must be the same in every stable phase; second, the total energy of a structure is simply the composition weighted sum of the constituent chemical potentials, $$E(x)=\Sigma_i N_i \mu_i \quad (2)$$

From these points, a linear system of equations was constructed where Equation 2 is defined for each stable phase at the LPSO structure composition (excluding the LPSO structure itself) and solve for each $\mu_i$. The formation energy, $\Delta E_F$, was defined similarly to $\Delta E_{stab}$ and Equation 3, but the $\mu_i$ chemical potentials were determined from the elemental structures instead of the equilibrium structures.

To calculate the set of stable phases (i.e. the convex hull), the Open Quantum Materials Database (OQMD) was employed, a high-throughput DFT database of total energies for every crystal structure found in the International Crystal Structure Database (ICSD) with primitive cells less than 30 atoms and without partial site occupancy. (See, J. Saal, S. Kirklin, B. Meredig, A. Thompson, J. Doak, C. Wolverton Under Prep (2013); G. Bergerhoff, R. Hundt, R. Sievers, I. D. Brown, Journal of Chemical Information and Modeling 23 (1983) 66-69 and A. Belsky, M. Hellenbrandt, V. L. Karen, P. Luksch, Acta Crystallographica Section B Structural Science 58 (2002) 364-369.) For the 140 Mg—$X^L$—$X^S$ ternary systems examined in this work, this amounts to DFT calculations of over 3900 compounds. From this database of compounds, the most stable set of structures at a given composition, from which $\mu_i$ were determined in Equation 3, were calculated by grand canonical linear programming (GCLP). (See, J. Saal, S. Kirklin, B. Meredig, A. Thompson, J. Doak, C. Wolverton Under Prep (2013); C. Wolverton, V. Ozoliš, Physical Review B 75 (2007) 1-15 and S. Kirklin, B. Meredig, C. Wolverton, Advanced Energy Materials 3 (2013) 252-262.) With GCLP, since both the composition and the free energy are linear as a function of quantity of different phases in a system, the set of phases that has the minimum total free energy at a given composition can be determined by linear programming.

To illustrate the application of Equation 3, the phases that were stable, excluding the LPSO structures, at the 14H-i $Mg_{71}Y_8Zn_6$ LPSO composition were Mg, MgYZn, and $Mg_3Y$ (as listed in Table 8). By Equation 3, the stability of the 14H-i $Mg_{71}Y_8Zn_6$ LPSO structure is the energy of the LPSO relative to the composition-weighted sum of the competing phases:

$$\Delta E_{stab}(Mg_{71}Y_8Zn_6)=E(Mg_{71}Y_8Zn_6)-59E(Mg)-6E(\mathrm{MgYZn})-2E(Mg_3Y) \quad (3)$$

The energy of this reaction, also given in Table 8, is −12 meV/atom, where the negative value indicates the phase is stable. In other words, the 14H-I $Mg_{71}Y_8Zn_6$ LPSO structure is a stable phase as it lies 12 meV/atom below the convex hull composed of Mg, MgYZn, and $Mg_3Y$.

It should be noted that the predicted stabilities were subject to the availability of crystal structures in the ICSD. For example, some of the experimentally observed ternary phases in the Mg—Y—Zn system (W—$Mg_3Y_2Zn_3$, Z—$Mg_{28}Y_7Zn_{65}$, I—$Mg_3YZn_6$, H—$Mg_{15}Y_{15}Zn_{70}$, X—$Mg_{12}YZn$) [34,35] do not have fully determined structures in the ICSD, so they are not included in the study. Therefore, the convex hull energetics in this work should be consider an upper bound on the true convex hull (i.e. the convex hull energies could be lower than those in the current work but not higher). Consequently, the DFT stabilities for the LPSO structures in this work are a lower bound (i.e. the stability could be more positive but not more negative than currently predicted).

The problem of unexplored systems and structures was approached by calculating simple ordered structures in the FCC, BCC, and HCP lattices for all systems in this work. The included simple structures were binary compounds ($L1_2$, $L1_0$, $D0_3$, B2, $B_h$, and $D0_{19}$) and the ternary $X_2YZ$ Heusler compound. In this way, these prototype structures may provide a better approximation for the convex hull energy in systems where experimentally determined crystal structures data may not be available. In other words, a predicted convex hull energy which includes a prototype will be more negative than without the prototype and closer to the true value. It appears this is an important consideration for the Mg—$X^L$—$X^S$ ternaries considered in this work since most of their convex hulls from the OQMD at LPSO compositions contain prototypes. The sets of stable phases at every LPSO composition are given in Tables 8-12.

Results and Discussion

Comparison of LPSO Structure Models

The 14H and 18R gradual LPSO structures by Egusa and Abe have stoichiometries of $Mg_{70}X^L{}_8X^S{}_6$ and $Mg_{58}X^L{}_8X^S{}_6$, respectively. (See, D. Egusa, E. Abe, Acta Materialia 60 (2012) 166-178.) The arrangement of the eight $X^L$ and six $X^S$ atoms within the four FCC stacked binary and ternary layers of the gradual LPSO structure model unit cell forms an $X^S{}_6X^L{}_8$ $L1_2$-arranged cluster in the Mg matrix, as shown in FIG. 1 for 14H. Egusa and Abe noted significant displacement of the $X^L$ and $X^S$ atoms in this cluster occurred after DFT relaxation of the ideal structure, with the $X^L$ atoms moving towards the center of the cluster and the $X^S$ atoms moving away, reducing the $X^S$—$X^S$ interatomic distance. Later DFT work from the same authors showed that this relaxation creates a large interstitial site at the body center of the $L1_2$ cluster, and the inclusion of an interstitial atom on this site thermodynamically stabilizes the structure. (See, D. Egusa, E. Abe, Presented at LPSO conference at Sapporo, Oct. 2, 2012 (2012).) Analysis of the Mg—Y—Zn 14H and 18R gradual structures from the calculations confirm this relaxation. The minimum nearest neighbor distances about the interstitial site (int) in the body center of the $L1_2$ cluster in the 14H structure are 3.16 and 3.40 Å for the int-Zn and int-Y distances, respectively, large enough for an interstitial atom to be included. This interstitial site is also indicated in FIG. 1. For comparison, the distance of the next largest interstitial site to a nearest neighbor is 2.25 Å, indicating that there exists only one large interstitial site in the gradual LPSO structure.

To test which species of interstitial atom (Mg, $X^L$, or $X^S$) is the most stable, the energy to insert interstitial atom i, $\Delta E^i_{int}$, was calculated for the three possible interstitial species in the 14H interstitial Mg—Y—Zn structure, $Mg_{70}Y_8Zn_6$ (int), where int is the interstitial atom:

$$\Delta E_{int}{}^{Mg}=Mg_{70}Y_8Zn_6(Mg)-Mg_{70}Y_8Zn_6-\mu_{Mg}=-1.864\ \mathrm{eV}/int \quad (4)$$

$$\Delta E_{int}{}^{Y}=Mg_{70}Y_8Zn_6(Y)-Mg_{70}Y_8Zn_6-\mu_{Y}=-1.474\ \mathrm{eV}/int \quad (5)$$

$$\Delta E_{int}{}^{Zn}=Mg_{70}Y_8Zn_6(Zn)-Mg_{70}Y_8Zn_6-\mu_{Zn}=-1.032\ \mathrm{eV}/int \quad (6)$$

Figure 2:
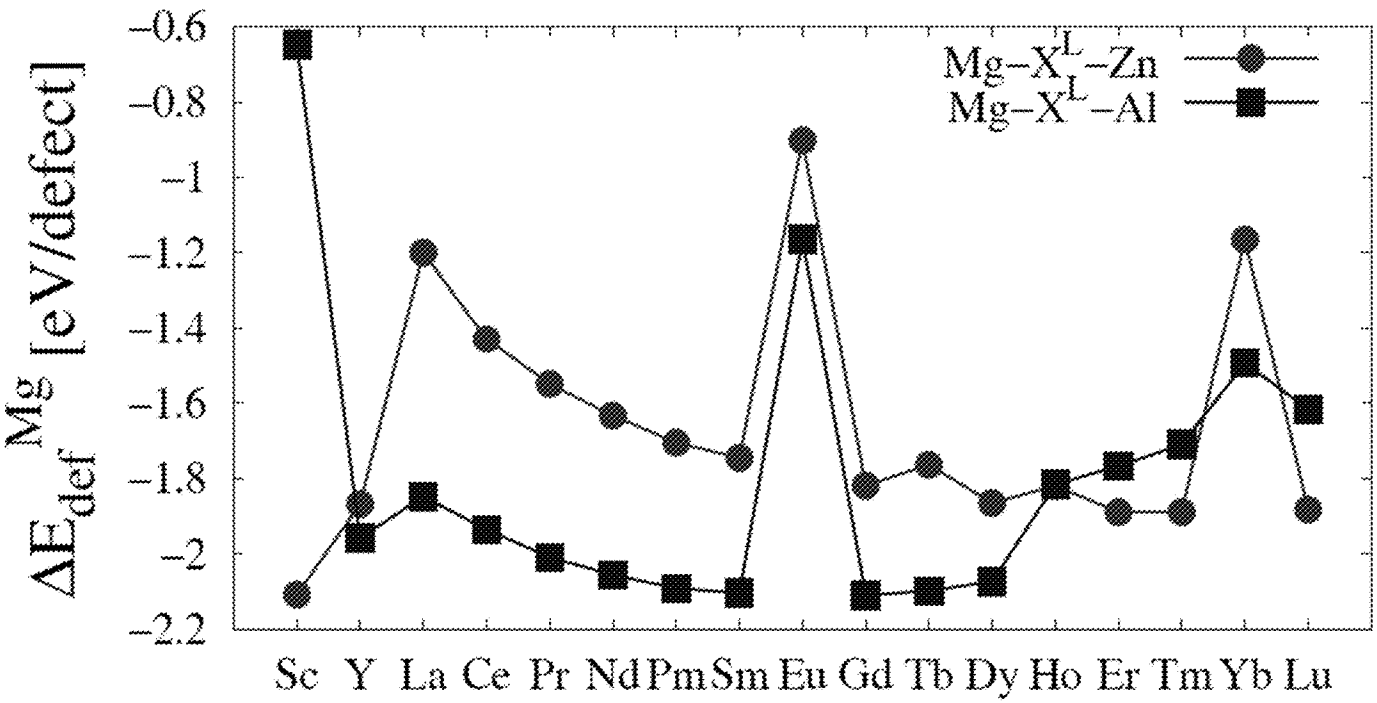
FIG. 2: DFT predicted Mg interstitial defect formation energy, $\Delta E_{int}{}^{Mg}$, for the gradual 14H LPSO structures (Equation 4). Negative values indicate the interstitial Mg atom promotes the stability of the LPSO structures.

For all three defect formation energies, the $\mu_i$ elemental chemical potentials were determined from the same set of stable compounds in the Mg—Y—Zn system at the LPSO composition: Mg, MgYZn, and $Mg_3Y$. Note that the experimentally observed stable Mg-rich Mg—Y binary compound is $Mg_{24}Y_5$, but the present DFT calculations predicted $Mg_3Y$ $D0_3$ as more stable. $Mg_{24}Y_5$ lies 3 meV/atom above the DFT convex hull, an energy difference that does not qualitatively affect the results in this work. All three interstitial defect formation energies were negative, indicating that they each stabilized the 14H gradual structure with their presence. Mg interstitials were predicted to be preferred as they have the most favorable formation energy and, thus, produced the most stable LPSO structure with respect to the other phases in the Mg—Y—Zn ternary system. The results for the DFT calculated Mg interstitial defect formation energies for the gradual 14H LPSO structures are shown in FIG. 2.

Figure 4:
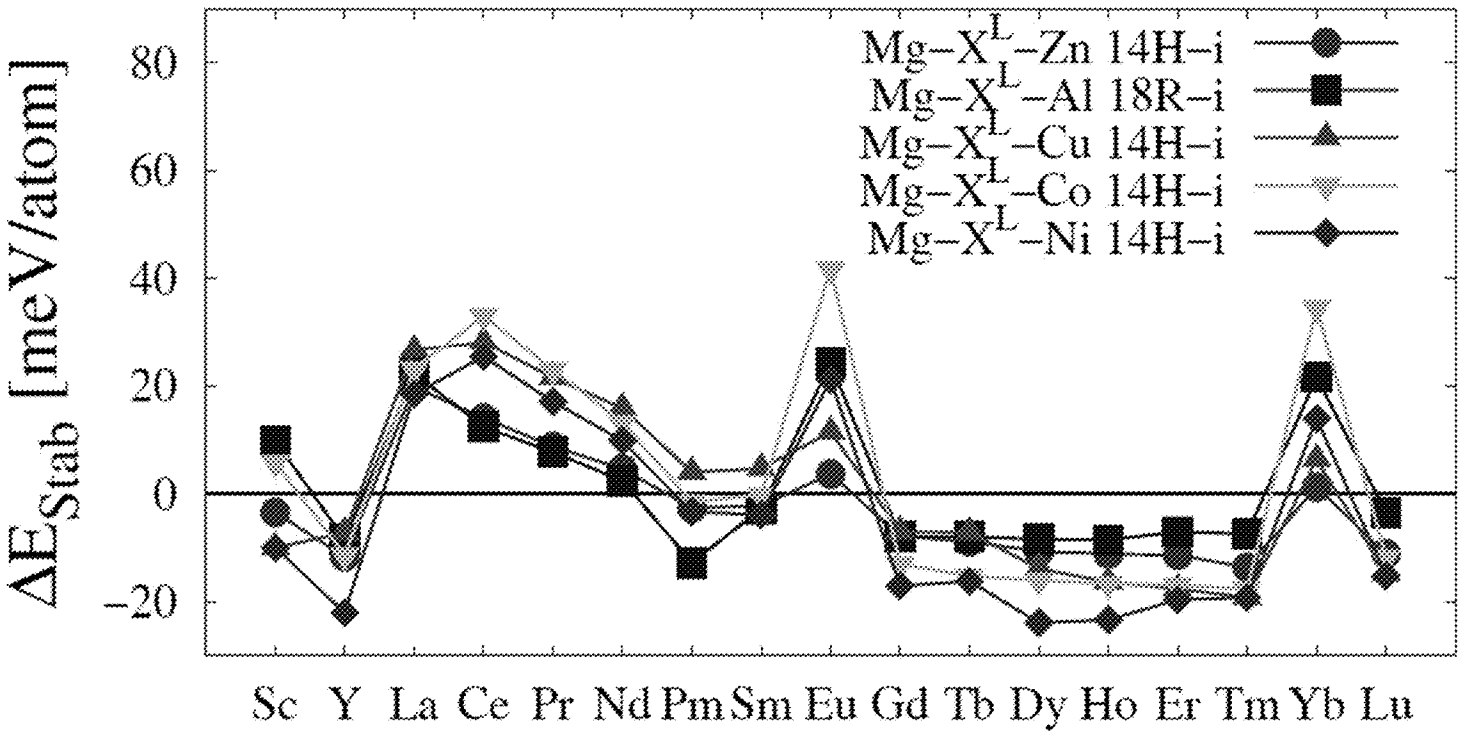
FIG. 4: DFT predicted relative stability of the indicated LPSO structure with respect to the lowest energy combination of all phases known from the ICSD and prototypes database in their respective ternary systems, $\Delta E_{stab}$. Negative values indicate the LPSO structure is thermodynamically stable. The sets of stable phases at the LPSO compositions can be found in Tables 8-12.

$\Delta E^{Mg}_{int}$ was calculated for the $X^L$=RE and $X^S$=Al, Zn LPSO systems, shown in FIG. 4. All the $\Delta E^{Mg}_{int}$ values were negative, indicating that the interstitial Mg atom promotes the stability of the LPSO structure, by as much as −2.109 eV/defect for the Mg—Gd—Al system. $\Delta E^{Mg}_{int}$ was also predicted for the 18R LPSO structure for a selection of ternary systems by:

$$\Delta E_{int}^{Mg} = Mg_{58}X_8^L X_6^S(Mg) - Mg_{58}X_8^L X_6^S - \mu_{Mg} \quad (7)$$

The resulting the 18R $\Delta E^{Mg}_{int}$ values are given in parentheses, in eV/defect: Mg—Gd—Zn (−1.846), Mg—Y—Cu (−1.6375), Mg—Y—Co (−1.698), Mg—Y—Ni (−1.623), Mg—Gd—Al (−2.137). As with the 14H structures, Mg interstitials stabilized the 18R structure. Indeed, for every case in this work, the LPSO structure with the interstitial Mg atoms are more stable than their gradual model equivalent. Based on these results, the remainder of the work focused on the LPSO gradual structures containing Mg interstitials, hereafter referred to as 14H-i and 18R-i. The DFT relaxed Mg—Y—Zn 14H-i and 18R-i crystal structures are given in Tables 1 and 2. The relaxed Mg-RE-$X^S$ 14H-i and 18R-i crystal structure parameters are provided in Tables 3-7.

TABLE 1

DFT relaxed atomic positions for the $Mg_{71}Y_8Zn_6$ 14H-i LPSO structure, with spacegroup $P6_3/mcm$ (193) and lattice parameters a = 11.15 Å c = 36.36 Å.

| Atom | site | x | y | z |
|---|---|---|---|---|
| Mg1 | 24l | 0.165 | 0.655 | 0.037 |
| Mg2ertg | 24l | 0.830 | 0.169 | 0.110 |
| Mg3 | 24l | 0.165 | 0.663 | 0.180 |
| Mg4 | 12k | 0.494 | 0.000 | 0.108 |
| Mg5 | 12k | 0.836 | 0.000 | 0.179 |
| Mg6 | 12k | 0.329 | 0.000 | 0.180 |
| Mg7 | 12j | 0.168 | 0.332 | 0.250 |
| Mg8 | 8h | 0.333 | 0.667 | 0.108 |
| Mg9 | 6g | 0.498 | 0.000 | 0.250 |
| Mg10 | 4c | 0.333 | 0.667 | 0.250 |
| Mg11 | 2a | 0.000 | 0.000 | 0.250 |
| Mg12 int | 2b | 0.000 | 0.000 | 0.000 |
| Zn | 12k | 0.777 | 0.000 | 0.049 |
| Y1 | 12k | 0.293 | 0.000 | 0.031 |
| Y2 | 4e | 0.000 | 0.000 | 0.096 |

TABLE 2

DFT relaxed atomic positions for the $Mg_{59}Y_8Zn_6$ 18R-i LPSO structure, with spacegroup C2/m (12) and lattice parameters a = 11.15 Å b = 19.34 Å c = 16.08 Å β = 76.49°.

| Atom | site | x | y | z |
|---|---|---|---|---|
| Mg1 | 8j | 0.059 | 0.918 | 0.918 |
| Mg2 | 8j | 0.053 | 0.752 | 0.917 |
| Mg3 | 8j | 0.056 | 0.583 | 0.916 |
| Mg4 | 8j | 0.306 | 0.832 | 0.918 |
| Mg5 | 8j | 0.305 | 0.665 | 0.919 |
| Mg6 | 8j | 0.084 | 0.834 | 0.751 |
| Mg7 | 8j | 0.084 | 0.670 | 0.756 |
| Mg8 | 8j | 0.330 | 0.915 | 0.756 |
| Mg9 | 8j | 0.330 | 0.748 | 0.751 |
| Mg10 | 8j | 0.840 | 0.915 | 0.756 |
| Mg11 | 8j | 0.191 | 0.828 | 0.586 |
| Mg12 | 8j | 0.956 | 0.918 | 0.586 |
| Mg13 | 8j | 0.938 | 0.755 | 0.586 |
| Mg14 | 4i | 0.310 | 0.000 | 0.918 |
| Mg15 | 4i | 0.803 | 0.000 | 0.916 |
| Mg16 | 4i | 0.089 | 0.000 | 0.751 |
| Mg17 int | 2d | 0.000 | 0.500 | 0.500 |
| Zn1 | 8j | 0.427 | 0.888 | 0.614 |
| Zn2 | 4i | 0.760 | 0.000 | 0.615 |

TABLE 2-continued

DFT relaxed atomic positions for the $Mg_{59}Y_8Zn_6$ 18R-i LPSO structure, with spacegroup C2/m (12) and lattice parameters a = 11.15 Å b = 19.34 Å c = 16.08 Å β = 76.49°.

| Atom | site | x | y | z |
|---|---|---|---|---|
| Y1 | 4j | 0.170 | 0.647 | 0.573 |
| Y2 | 4i | 0.574 | 0.000 | 0.724 |
| Y3 | 4i | 0.232 | 0.000 | 0.572 |

TABLE 3

DFT relaxed lattice parameters for the Mg—$X^L$—Zn LPSO structures, in Å.

| | | 18R-i | | | | 14H-i | |
|---|---|---|---|---|---|---|---|
| | $X^L$ | a | b | c | β[°] | a | c |
| Exp.[16] | Sc | 10.99 | 19.05 | 15.84 | 76.52 | 11.00 | 35.94 |
| | Y | 11.15 | 19.34 | 16.08 | 76.49 | 11.15 | 36.36 |
| | Y | 11.1 | 19.3 | 16.0 | 76.5 | 11.1 | 36.5 |
| | La | 11.33 | 19.65 | 16.33 | 76.32 | 11.31 | 36.80 |
| | Ce | 11.31 | 19.61 | 16.29 | 76.33 | 11.30 | 36.73 |
| | Pr | 11.28 | 19.56 | 16.25 | 76.35 | 11.27 | 36.67 |
| | Nd | 11.25 | 19.51 | 16.23 | 76.38 | 11.24 | 36.63 |
| | Pm | 11.24 | 19.48 | 16.19 | 76.38 | 11.23 | 36.56 |
| | Sm | 11.21 | 19.44 | 16.18 | 76.41 | 11.21 | 36.54 |
| | Eu | 11.31 | 19.64 | 16.36 | 76.41 | 11.31 | 36.95 |
| | Gd | 11.17 | 19.38 | 16.11 | 76.42 | 11.18 | 36.45 |
| | Tb | 11.16 | 19.36 | 16.09 | 76.42 | 11.16 | 36.42 |
| | Dy | 11.15 | 19.33 | 16.07 | 76.47 | 11.15 | 36.38 |
| | Ho | 11.13 | 19.31 | 16.06 | 76.45 | 11.15 | 36.39 |
| | Er | 11.12 | 19.28 | 16.03 | 76.46 | 11.13 | 36.33 |
| | Tm | 11.10 | 19.25 | 16.02 | 76.48 | 11.11 | 36.29 |
| | Yb | 11.24 | 19.49 | 16.26 | 76.48 | 11.22 | 36.72 |
| | Lu | 11.08 | 19.21 | 15.99 | 76.49 | 11.09 | 36.27 |
| | Tl | 11.03 | 19.17 | 16.09 | 76.85 | 11.04 | 36.56 |
| | Sb | 11.06 | 19.13 | 15.96 | 76.73 | 11.06 | 36.26 |
| | Pb | 11.09 | 19.22 | 16.12 | 76.74 | 11.08 | 36.68 |
| | Na | 11.10 | 19.23 | 16.16 | 76.62 | 11.10 | 36.61 |
| | Te | 11.09 | 19.13 | 16.35 | 76.54 | 11.06 | 37.12 |
| | Bi | 11.15 | 19.29 | 16.10 | 76.55 | 11.12 | 36.56 |
| | Pa | 11.11 | 19.25 | 16.01 | 76.56 | 11.10 | 36.27 |
| | Ca | 11.24 | 19.50 | 16.24 | 76.46 | 11.23 | 36.72 |
| | Th | 11.25 | 19.49 | 16.14 | 76.51 | 11.23 | 36.51 |
| | K | 11.51 | 19.90 | 16.62 | 76.62 | 11.41 | 37.70 |
| | Sr | 11.42 | 19.80 | 16.44 | 76.46 | 11.40 | 37.11 |

TABLE 4

DFT relaxed lattice parameters for the Mg—$X^L$—Al LPSO structures, in Å.

| | 18R-i | | | | 14H-i | |
|---|---|---|---|---|---|---|
| $X^L$ | a | b | c | β[°] | a | c |
| Sc | 11.03 | 19.11 | 15.90 | 76.58 | 11.04 | 36.04 |
| Y | 11.21 | 19.41 | 16.10 | 76.47 | 11.19 | 36.42 |
| La | 11.41 | 19.75 | 16.32 | 76.36 | 11.37 | 36.80 |
| Ce | 11.39 | 19.71 | 16.29 | 76.36 | 11.35 | 36.75 |
| Pr | 11.35 | 19.65 | 16.25 | 76.38 | 11.32 | 36.69 |
| Nd | 11.33 | 19.61 | 16.23 | 76.40 | 11.30 | 36.61 |
| Pm | 11.30 | 19.57 | 16.20 | 76.43 | 11.27 | 36.58 |
| Sm | 11.28 | 19.53 | 16.18 | 76.44 | 11.26 | 36.54 |
| Eu | 11.42 | 19.81 | 16.42 | 76.41 | 11.39 | 37.02 |
| Gd | 11.24 | 19.46 | 16.14 | 76.48 | 11.23 | 36.48 |
| Tb | 11.21 | 19.42 | 16.11 | 76.48 | 11.21 | 36.45 |
| Dy | 11.20 | 19.40 | 16.10 | 76.50 | 11.20 | 36.44 |
| Ho | 11.19 | 19.37 | 16.09 | 76.50 | 11.18 | 36.41 |
| Er | 11.17 | 19.36 | 16.08 | 76.53 | 11.17 | 36.39 |
| Tm | 11.16 | 19.34 | 16.07 | 76.55 | 11.16 | 36.37 |
| Yb | 11.32 | 19.63 | 16.30 | 76.49 | 11.29 | 36.82 |
| Lu | 11.13 | 19.30 | 16.05 | 76.56 | 11.13 | 36.35 |

TABLE 4-continued

DFT relaxed lattice parameters for the Mg—$X^L$—Al LPSO structures, in Å.

| | 18R-i | | | | 14H-i | |
|---|---|---|---|---|---|---|
| $X^L$ | a | b | c | β[°] | a | c |
| Tl | 11.03 | 19.13 | 16.19 | 76.94 | 11.03 | 36.80 |
| Sb | 11.07 | 19.19 | 16.14 | 76.81 | 11.07 | 36.58 |
| Pb | 11.14 | 19.30 | 16.10 | 76.61 | 11.13 | 36.52 |
| Na | 11.17 | 19.35 | 16.19 | 76.62 | 11.15 | 36.71 |
| Te | 11.10 | 19.26 | 16.44 | 77.26 | 11.13 | 37.12 |
| Bi | 11.14 | 19.30 | 16.16 | 76.72 | 11.12 | 36.69 |
| Pa | 11.16 | 19.32 | 16.09 | 76.60 | 11.15 | 36.45 |
| Ca | 11.38 | 19.71 | 16.37 | 76.49 | 11.30 | 36.81 |
| Th | 11.32 | 19.59 | 16.21 | 76.55 | 11.29 | 36.65 |
| K | 11.67 | 20.20 | 16.52 | 76.64 | 11.55 | 37.48 |
| Sr | 11.50 | 19.96 | 16.50 | 76.41 | 11.46 | 37.19 |

TABLE 5

DFT relaxed lattice parameters for the Mg—$X^L$—Cu LPSO structures, in Å.

| | 18R-i | | | | 14H-i | |
|---|---|---|---|---|---|---|
| $X^L$ | a | b | c | β[°] | a | c |
| Sc | 10.94 | 18.96 | 15.77 | 76.55 | 10.96 | 35.80 |
| Y | 11.08 | 19.22 | 16.03 | 76.55 | 11.09 | 36.25 |
| La | 11.23 | 19.49 | 16.23 | 76.35 | 11.25 | 36.72 |
| Ce | 11.22 | 19.49 | 16.23 | 76.36 | 11.22 | 36.64 |
| Pr | 11.19 | 19.42 | 16.18 | 76.39 | 11.20 | 36.58 |
| Nd | 11.17 | 19.39 | 16.16 | 76.43 | 11.17 | 36.49 |
| Pm | 11.15 | 19.35 | 16.13 | 76.47 | 11.71 | 38.26 |
| Sm | 11.13 | 19.32 | 16.11 | 76.48 | 11.15 | 36.43 |
| Eu | 11.22 | 19.46 | 16.28 | 76.53 | 11.20 | 36.87 |
| Gd | 11.09 | 19.25 | 16.06 | 76.52 | 11.11 | 36.32 |
| Tb | 11.08 | 19.22 | 16.04 | 76.53 | 11.10 | 36.30 |
| Dy | 11.08 | 19.21 | 16.03 | 76.56 | 11.09 | 36.26 |
| Ho | 11.06 | 19.18 | 16.00 | 76.56 | 11.08 | 36.23 |
| Er | 11.05 | 19.15 | 15.98 | 76.57 | 11.07 | 36.21 |
| Tm | 11.03 | 19.14 | 15.96 | 76.58 | 11.06 | 36.17 |
| Yb | 11.13 | 19.31 | 16.19 | 76.60 | 11.12 | 36.69 |
| Lu | 11.02 | 19.10 | 15.93 | 76.55 | 11.04 | 36.12 |
| Tl | 10.93 | 18.96 | 15.94 | 76.70 | 10.98 | 36.14 |
| Sb | 10.94 | 18.98 | 15.86 | 76.62 | 10.96 | 36.01 |
| Pb | 10.97 | 19.01 | 16.05 | 76.94 | 10.99 | 36.43 |
| Na | 11.04 | 19.11 | 16.00 | 76.67 | 11.03 | 36.41 |
| Te | 11.00 | 19.04 | 16.13 | 76.74 | 11.01 | 36.59 |
| Bi | 11.00 | 19.07 | 16.03 | 76.70 | 11.02 | 36.38 |
| Pa | 11.03 | 19.10 | 15.91 | 76.51 | 11.04 | 36.12 |
| Ca | 11.17 | 19.37 | 16.23 | 76.60 | 11.14 | 36.70 |
| Th | 11.16 | 19.34 | 16.08 | 76.47 | 11.15 | 36.37 |
| K | 11.39 | 19.72 | 16.60 | 76.71 | 11.33 | 37.63 |
| Sr | 11.31 | 19.61 | 16.40 | 76.56 | 11.29 | 37.13 |

TABLE 6

DFT relaxed lattice parameters for the Mg—$X^L$—Co LPSO structures, in Å.

| | 18R-i | | | | 14H-i | |
|---|---|---|---|---|---|---|
| $X^L$ | a | b | c | β[°] | a | c |
| Sc | 10.91 | 18.91 | 15.73 | 76.60 | 10.94 | 35.78 |
| Y | 11.03 | 19.12 | 15.96 | 76.61 | 11.03 | 36.25 |
| La | 11.16 | 19.31 | 16.14 | 76.57 | 11.14 | 36.55 |
| Ce | 11.15 | 19.31 | 16.15 | 76.57 | 11.14 | 36.58 |
| Pr | 11.12 | 19.26 | 16.10 | 76.58 | 11.12 | 36.50 |
| Nd | 11.12 | 19.26 | 16.09 | 76.57 | 11.11 | 36.48 |
| Pm | 11.10 | 19.22 | 16.05 | 76.59 | 11.09 | 36.42 |
| Sm | 11.06 | 19.17 | 16.01 | 76.58 | 11.07 | 36.35 |
| Eu | 11.02 | 19.08 | 16.04 | 76.76 | 11.11 | 36.71 |

TABLE 6-continued

DFT relaxed lattice parameters for the Mg—$X^L$—Co LPSO structures, in Å.

| | 18R-i | | | | 14H-i | |
|---|---|---|---|---|---|---|
| $X^L$ | a | b | c | β[°] | a | c |
| Gd | 11.06 | 19.17 | 16.00 | 76.59 | 11.05 | 36.27 |
| Tb | 11.03 | 19.11 | 15.95 | 76.58 | 11.03 | 36.24 |
| Dy | 11.02 | 19.10 | 15.94 | 76.58 | 11.02 | 36.21 |
| Ho | 11.01 | 19.09 | 15.92 | 76.58 | 11.02 | 36.19 |
| Er | 11.00 | 19.08 | 15.91 | 76.59 | 11.01 | 36.17 |
| Tm | 10.99 | 19.05 | 15.88 | 76.58 | 11.00 | 36.13 |
| Yb | 11.06 | 19.15 | 16.07 | 76.70 | 11.05 | 36.47 |
| Lu | 10.97 | 19.02 | 15.86 | 76.60 | 10.98 | 36.07 |
| Tl | 10.84 | 18.80 | 15.77 | 76.74 | 10.87 | 35.93 |
| Sb | 10.80 | 18.75 | 15.88 | 76.96 | 10.86 | 36.14 |
| Pb | 10.85 | 18.82 | 15.94 | 77.09 | 10.88 | 36.32 |
| Na | 10.96 | 18.99 | 15.85 | 76.68 | 10.98 | 36.09 |
| Te | 10.87 | 18.84 | 15.93 | 76.84 | 10.93 | 36.13 |
| Bi | 10.87 | 18.86 | 15.99 | 77.02 | 10.92 | 36.40 |
| Pa | 11.01 | 19.05 | 15.85 | 76.45 | 11.01 | 36.00 |
| Ca | 11.08 | 19.18 | 16.11 | 76.74 | 11.07 | 36.52 |
| Th | 11.12 | 19.26 | 16.02 | 76.41 | 11.11 | 36.31 |
| K | 11.33 | 19.63 | 16.58 | 76.82 | 11.28 | 37.49 |
| Sr | 11.25 | 19.44 | 16.38 | 76.84 | 11.20 | 37.03 |

TABLE 7

DFT relaxed lattice parameters for the Mg—$X^L$—Ni LPSO structures, in Å.

| | 18R-i | | | | 14H-i | |
|---|---|---|---|---|---|---|
| $X^L$ | a | b | c | β[°] | a | c |
| Sc | 10.94 | 18.94 | 15.73 | 76.63 | 10.94 | 35.75 |
| Y | 11.04 | 19.14 | 15.95 | 76.56 | 11.06 | 36.22 |
| La | 11.19 | 19.39 | 16.15 | 76.40 | 11.18 | 36.58 |
| Ce | 11.18 | 19.38 | 16.14 | 76.40 | 11.17 | 36.53 |
| Pr | 11.15 | 19.33 | 16.10 | 76.40 | 11.15 | 36.47 |
| Nd | 11.14 | 19.32 | 16.09 | 76.42 | 11.13 | 36.44 |
| Pm | 11.11 | 19.26 | 16.05 | 76.44 | 11.11 | 36.37 |
| Sm | 11.09 | 19.23 | 16.02 | 76.46 | 11.09 | 36.33 |
| Eu | 11.16 | 19.31 | 16.17 | 76.69 | 11.69 | 38.55 |
| Gd | 11.07 | 19.19 | 15.99 | 76.50 | 11.07 | 36.26 |
| Tb | 11.06 | 19.17 | 15.97 | 76.52 | 11.06 | 36.22 |
| Dy | 11.04 | 19.14 | 15.95 | 76.54 | 11.05 | 36.19 |
| Ho | 11.03 | 19.12 | 15.93 | 76.55 | 11.03 | 36.15 |
| Er | 11.02 | 19.10 | 15.91 | 76.57 | 11.03 | 36.15 |
| Tm | 11.01 | 19.09 | 15.90 | 76.59 | 11.02 | 36.11 |
| Yb | 11.09 | 19.19 | 16.10 | 76.69 | 11.07 | 36.57 |
| Lu | 10.99 | 19.05 | 15.86 | 76.61 | 11.01 | 36.08 |
| Tl | 10.85 | 18.80 | 15.87 | 76.78 | 10.88 | 36.08 |
| Sb | 10.82 | 18.76 | 15.90 | 76.91 | 10.87 | 36.11 |
| Pb | 10.91 | 18.93 | 15.94 | 76.84 | 10.94 | 36.31 |
| Na | 11.01 | 19.04 | 15.89 | 76.91 | 11.00 | 36.25 |
| Te | 10.88 | 18.85 | 16.00 | 77.40 | 10.92 | 36.45 |
| Bi | 10.90 | 18.89 | 16.04 | 76.93 | 10.93 | 36.37 |
| Pa | 11.01 | 19.05 | 15.85 | 76.46 | 11.01 | 36.03 |
| Ca | 11.09 | 19.20 | 16.09 | 76.69 | 11.08 | 36.59 |
| Th | 11.13 | 19.29 | 16.02 | 76.39 | 11.12 | 36.26 |
| K | 11.35 | 19.64 | 16.55 | 76.83 | 11.31 | 37.50 |
| Sr | 11.27 | 19.48 | 16.35 | 76.70 | 11.22 | 37.05 |

In precipitation experiments, LPSO systems are often observed to initially form the 18R structure and then transform to 14H after annealing. (See, Y. Kawamura, M. Yamasaki, Materials Transactions 48 (2007) 2986-2992 and T. Itoi, T. Seimiya, Y. Kawamura, M. Hirohashi, Scripta Materialia 51 (2004) 107-111.) Mg—Gd—Al is a notable exception, where only the 18R structure has been observed. (See, H. Yokobayashi, K. Kishida, H. Inui, M. Yamasaki, Y. Kawamura, Acta Materialia 59 (2011) 7287-7299.) Previous work showed that calculations are consistent with experiments for the Mg—Y—Zn system, where the 14H structure is more stable than 18R and Mg. (See, J. Saal, C. Wolverton, Scripta Materialia 67 (2012) 798-801.) A corresponding relationship between the 14H-i and 18R-i structures is given by the following transformation:

$$2Mg_{59}X_8^LX_6^S[18R-i]+12Mg \rightarrow Mg_{71}X_8^LX_6^S[14H-i] \quad (8)$$

Figure 3:
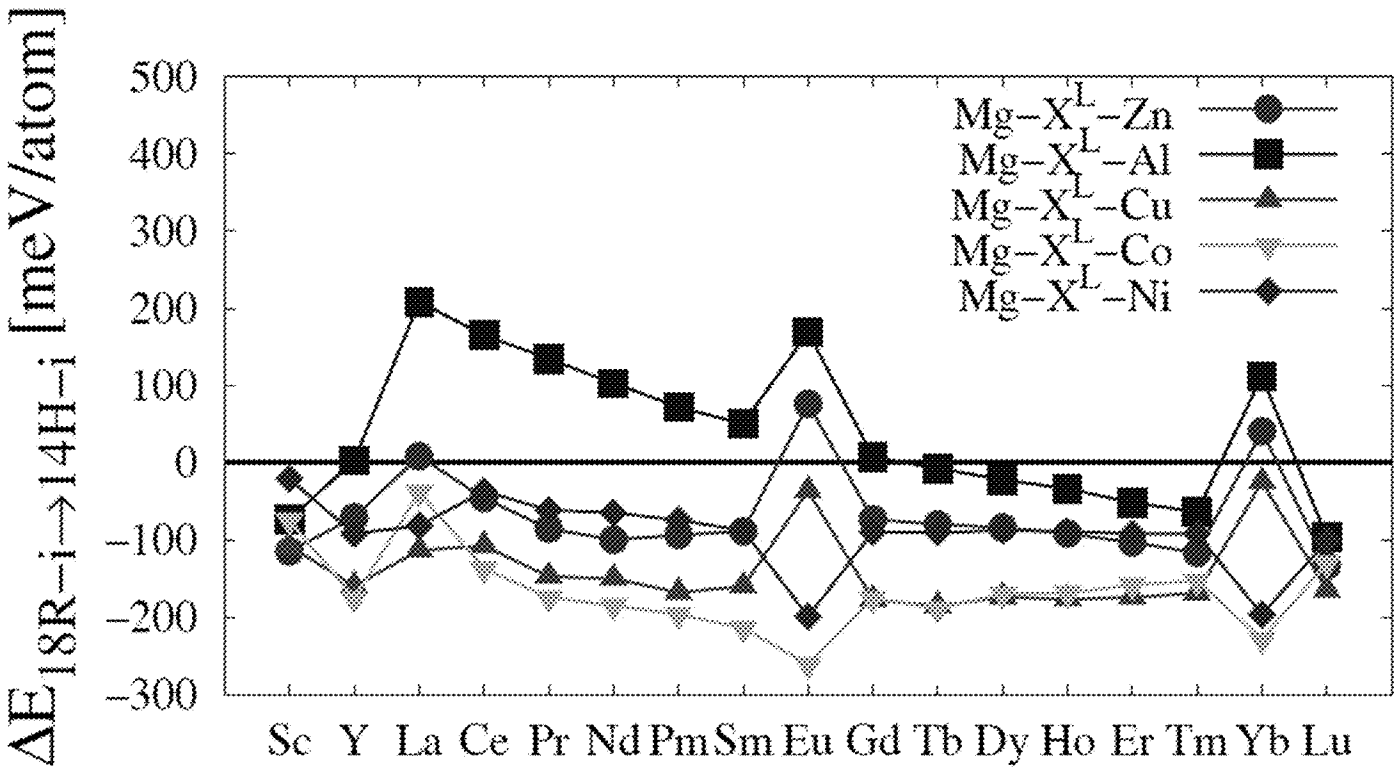
FIG. 3: DFT predicted energy for the transformation between the 18R-i and 14H-i LPSO structures (Equation 8), $\Delta E_{18R\text{-}i\rightarrow 14H\text{-}i}$. Negative values indicate the 14H-i structure is energetically preferred over 18R-i.

The DFT predicted energy for this transformation, $\Delta E_{18R-i \rightarrow 14H-i}$, for every RE-containing LPSO system in this work ($X^L$=RE and $X^S$=Zn, Al, Cu, Co, Ni) is shown in FIG. 3. A negative value for $\Delta E_{18R-i \rightarrow 14H-i}$ indicates the 14H-i structure is more stable than 18R-i and Mg. For most of the systems, the 14H-i structure was more stable, in agreement with experimental observation. Furthermore, for the first half of the Mg-RE-Al series, we predict that the 18R-Ii structure was predicted to be preferred, consistent with experimental observation of a preference for 18R LPSO formation in the Mg—Gd—Al system. (See, H. Yokobayashi, K. Kishida, H. Inui, M. Yamasaki, Y. Kawamura, Acta Materialia 59 (2011) 7287-7299.) This agreement with experiments, where available, indicates that the interstitial LPSO structure model is accurate.

Thermodynamic Stability of Mg-RE-$X^S$ LPSO Structures

The formation energies ($\Delta E_F$) and stabilities ($\Delta E_{stab}$) of the Mg-RE-$X^S$ LPSO structures are summarized in FIG. 4. Nearly all Mg-RE-$X^S$ LPSO phases have negative formation energies, indicating they are stable with respect to the elements—only the Mg—Eu—Co and Mg—Yb—Co LPSO formation energies are positive. However, a negative formation energy is not a sufficient condition for an LPSO structure to be stable. The LPSO structure must also be more stable than any combination of every other phase in the ternary system, as quantified by $\Delta E_{stab}$. To predict $\Delta E_{stab}$ of the LPSO structures, the most stable set of competing phases at the 18R-I $Mg_{59}X^L{}_8X^S{}_6$ and 14H-i $Mg_{71}X^L{}_8X^S{}_6$ compositions was determined. These phases are provided in Tables 8-12. Several 14H-I structures (and 18R-I for $X^S$=Al) have negative values of $\Delta E_{stab}$, indicating they are thermodynamically stable, including Mg—Y—Zn. This stability is in contrast to our previous work where, for 14H Mg—Y—Zn LPSO without the interstitial, the structure lies 11 meV/atom above the convex hull. (See, J. Saal, C. Wolverton, Scripta Materialia 67 (2012) 798-801.) 14H-i Mg—Y—Zn, in this work, is 12 meV/atom below the convex hull. Thus, using the new interstitial crystal structure, DFT predicts that LPSO structures, in many cases, are thermodynamic ground states.

TABLE 8

Formation energies and stabilities for the Mg-$X^L$-Zn LPSO structures, in meV/atom. The stable convex hull compounds is given in order of decreasing phase fraction. The number for ICSD compound or the Strukturbericht designation for the simple ordered compounds is given in parentheses. The compounds are the same for both the 18R-i $Mg_{59}X_8{}^LZn_6$ and 14H-i $Mg_{71}X_8{}^LZn_6$ compositions, unless indicated otherwise by a footnote. A negative stability indicates the LPSO structure is more stable than the convex hull phases.

| | 18R-i | | 14H-i | | |
|---|---|---|---|---|---|
| $X^L$ | $\Delta E_F$ | $\Delta E_{stab}$ | $\Delta E_F$ | $\Delta E_{stab}$ | Convex Hull Phases |
| Sc | −77 | −4 | −66 | −3 | Mg(A3/HCP),ScZn(B2),$Mg_3Sc(D0_{19})$ |
| Y | −98 | −13 | −85 | −12 | Mg(A3/HCP),MgYZn(160907),$Mg_3Y(D0_3)$ |
| La | −86 | 23 | −74 | 20 | $Mg_{12}La$(168466),$MgLaZn_2$(Heusler),Mg(A3/HCP)[a] |
| Ce | −88 | 16 | −76 | 14 | $Mg_{12}Ce$(621495),$MgCeZn_2$(Heusler),Mg(A3/HCP)[b] |
| Pr | −91 | 10 | −78 | 9 | $Mg_{12}Pr$(104856),$MgPrZn_2$(Heusler),Mg(A3/HCP)[c] |
| Nd | −92 | 6 | −79 | 5 | $Mg_{41}Nd_5$(642680),Mg(A3/HCP),$MgNdZn_2$(Heusler) |
| Pm | −93 | −2 | −81 | −3 | Mg(A3/HCP),$Mg_3Pm(D0_{22})$,$MgPmZn_2$(Heusler) |
| Sm | −93 | −2 | −80 | −2 | $Mg_{41}Sm_5$(642842),Mg(A3/HCP),$MgSmZn_2$(Heusler) |
| Eu | −79 | 4 | −67 | 4 | Mg(A3/HCP),$Mg_2Eu$(412689),$MgEuZn_2$(Heusler) |
| Gd | −92 | −8 | −80 | −8 | Mg(A3/HCP),$Mg_3Gd(D0_3)$,$MgGdZn_2$(Heusler) |
| Tb | −91 | −10 | −79 | −9 | Mg(A3/HCP),$Mg_3Tb(D0_3)$,$MgTbZn_2$(Heusler) |
| Dy | −90 | −12 | −78 | −11 | Mg(A3/HCP),$Mg_3Dy(D0_3)$,$MgDyZn_2$(Heusler) |
| Ho | −88 | −13 | −76 | −11 | Mg(A3/HCP),$Mg_3Ho(D0_3)$,$MgHoZn_2$(Heusler) |
| Er | −86 | −13 | −74 | −11 | Mg(A3/HCP),$Mg_{24}Er_5$(109136),$MgErZn_2$(Heusler) |
| Tm | −83 | −15 | −72 | −14 | Mg(A3/HCP),$Mg_3Tm(D0_3)$,$MgTmZn_2$(Heusler) |
| Yb | −70 | 1 | −60 | 1 | Mg(A3/HCP),$Mg_2Yb$(104895),$YbZn_2$(106234) |
| Lu | −77 | −12 | −67 | −11 | Mg(A3/HCP),LuZn(B2),$Mg_{24}Lu_5$(642418) |
| Tl | −6 | 38 | −5 | 33 | Mg(A3/HCP),$Mg_3Tl(D0_{19})$,$Mg_{21}Zn_{25}$(240047) |
| Sb | −35 | 86 | −30 | 74 | Mg(A3/HCP),$Mg_3Sb_2$(2142),$Mg_{21}Zn_{25}$(240047) |
| Pb | −13 | 40 | −10 | 36 | Mg(A3/HCP),$Mg_3Pb(L1_2)$,$Mg_{21}Zn_{25}$(240047) |
| Na | 17 | 36 | 14 | 31 | Mg(A3/HCP),$Mg_{21}Zn_{25}$(240047),Na(C19) |
| Te | −52 | 165 | −45 | 141 | Mg(A3/HCP),MgTe(52363),$Mg_{21}Zn_{25}$(240047) |
| Bi | −27 | 58 | −23 | 50 | Mg(A3/HCP),$Mg_3Bi_2$(659569),$Mg_{21}Zn_{25}$(240047) |
| Pa | 66 | 85 | 56 | 73 | Mg(A3/HCP),$Mg_{21}Zn_{25}$(240047),Pa(A1/FCC) |
| Ca | −71 | −3 | −60 | −2 | Mg(A3/HCP),$CaMg_2$(165564),$CaZn_2$(58945) |
| Th | −49 | −11 | −42 | −9 | Mg(A3/HCP),$Th_2Zn$(653254),$MgThZn_2$(Heusler) |
| K | 75 | 94 | 67 | 84 | Mg(A3/HCP),$Mg_{21}Zn_{25}$(240047),K(A2/BCC) |
| Sr | −43 | 19 | −37 | 16 | $Mg_{23}Sr_6$(104876),Mg(A3/HCP),$Mg_{21}Zn_{25}$(240047) |

[a] 18R-i: $Mg_{12}La$(168466),$MgLaZn_2$(Heusler),$Mg_3La(D0_3)$

[b] 18R-i: $Mg_{12}Ce$(621495),$MgCeZn_2$(Heusler),$Mg_{41}Ce_5$(621487)

[c] 18R-i: $Mg_{12}Pr$(104856),$MgPrZn_2$(Heusler),$Mg_{41}Pr_5$(642771)

TABLE 9

Formation energies and stabilities for the Mg-$X^L$-Al LPSO structures, in meV/atom. The stable convex hull compounds is given in order of decreasing phase fraction. The number for ICSD compound or the Strukturbericht designation for the simple ordered compounds is given in parentheses. The compounds are the same for both the 18R-i $Mg_{59}X_8{}^LAl_6$ and 14H-i $Mg_{71}X_8{}^LAl_6$ compositions, unless indicated otherwise by a footnote. A negative stability indicates the LPSO structure is more stable than the convex hull phases.

| | 18R-i | | 14H-i | | |
|---|---|---|---|---|---|
| $X^L$ | $\Delta E_F$ | $\Delta E_{stab}$ | $\Delta E_F$ | $\Delta E_{stab}$ | Convex Hull Phases |
| Sc | −76 | 10 | −66 | 7 | Mg(A3/HCP),AlSc(B2),$MgAlSc_2$(Heusler) |
| Y | −101 | −8 | −87 | −7 | Mg(A3/HCP),MgAlY(160908),$Mg_3Y(D0_3)$ |
| La | −93 | 22 | −78 | 21 | $Mg_{12}La$(168466),Mg(A3/HCP),$Al_2La$(57933)[a] |
| Ce | −96 | 12 | −81 | 12 | $Mg_{12}Ce$(621495),Mg(A3/HCP),$Al_2Ce$(57555)[b] |
| Pr | −98 | 8 | −84 | 7 | $Mg_{12}Pr$(104856),Mg(A3/HCP),$Al_2Pr$(150504)[c] |
| Nd | −100 | 2 | −85 | 3 | $Mg_{41}Nd_5$(642680),Mg(A3/HCP),$Al_2Nd$(58027) |
| Pm | −101 | −13 | −86 | −10 | Mg(A3/HCP),$Mg_3Pm(D0_{22})$,$Al_3Pm(D0_{19})$ |
| Sm | −100 | −3 | −85 | −2 | $Mg_{41}Sm_5$(642842),Mg(A3/HCP),$Al_2Sm$(58161) |
| Eu | −58 | 24 | −49 | 21 | Mg(A3/HCP),$Mg_2Eu$(412689),$Al_2Eu$(57783) |
| Gd | −98 | −8 | −84 | −7 | Mg(A3/HCP),$Mg_3Gd(D0_3)$,$Al_2Gd$(57868) |
| Tb | −96 | −8 | −82 | −7 | Mg(A3/HCP),$Mg_3Tb(D0_3)$,$Al_2Tb$(58174) |
| Dy | −93 | −8 | −80 | −7 | Mg(A3/HCP),$Mg_3Dy(D0_3)$,$Al_2Dy$(107648) |
| Ho | −91 | −9 | −78 | −8 | Mg(A3/HCP),$Mg_3Ho(D0_3)$,$Al_2Ho$(57911) |
| Er | −87 | −7 | −75 | −7 | Mg(A3/HCP),$Mg_{24}Er_5$(109136),$Al_2Er$(57764) |
| Tm | −82 | −7 | −71 | −7 | Mg(A3/HCP),$Mg_3Tm(D0_3)$,$Al_2Tm$(58192) |
| Yb | −47 | 22 | −40 | 19 | Mg(A3/HCP),$Mg_2Yb$(104895),$Al_2Yb$(58223) |
| Lu | −75 | −4 | −65 | −4 | Mg(A3/HCP),$Mg_{24}Lu_5$(62418),$Al_2Lu$(57958) |
| Tl | 25 | 54 | 21 | 46 | Mg(A3/HCP),$Mg_3Tl(D0_{19})$,$Mg_{17}Al_{12}$(23607) |
| Sb | −5 | 102 | −4 | 88 | Mg(A3/HCP),$Mg_3Sb_2$(2142),$Mg_{17}Al_{12}$(23607) |
| Pb | 17 | 56 | 15 | 48 | Mg(A3/HCP),$Mg_3Pb(L1_2)$,$Mg_{17}Al_{12}$(23607) |
| Na | 45 | 50 | 39 | 43 | Mg(A3/HCP),$Mg_{17}Al_{12}$(23607),Na(C19) |
| Te | −17 | 185 | −14 | 160 | Mg(A3/HCP),MgTe(52363),$Mg_{17}Al_{12}$(23607) |
| Bi | 3 | 73 | 3 | 63 | Mg(A3/HCP),$Mg_3Bi_2$(659569),$Mg_{17}Al_{12}$(23607) |
| Pa | 53 | 85 | 45 | 72 | Mg(A3/HCP),$AlPa_3(D0_{22})$,$Al_3Pa$(D019) |
| Ca | −55 | 16 | −47 | 14 | Mg(A3/HCP),$CaMg_2$(165564),$CaAl_2$(30213) |
| Th | −55 | 2 | −47 | 2 | Mg(A3/HCP),$AlTh_2$(58180),$Al_2Th$(15447) |
| K | 104 | 109 | 92 | 96 | Mg(A3/HCP),$Mg_{17}Al_{12}$(23607),K(A2/BCC) |
| Sr | −29 | 30 | −23 | 27 | Mg(A3/HCP),$Mg_{23}Sr_6$(104876),$SrAl_2$(58166) |

[a]18R-i: $Mg_{12}La$(168466),$Al_2La$(57933),$Mg_3La(D0_3)$
[b]18R-i: $Mg_{12}Ce$(621495),$Al_2Ce$(57555),$Mg_{41}Ce_5$(621487)
[c]18R-i: $Mg_{12}Pr$(104856),$Al_2Pr$(150504),$Mg_{41}Pr_5$(642771)

TABLE 10

Formation energies and stabilities for the Mg-$X^L$-Cu LPSO structures, in meV/atom. The stable convex hull compounds is given in order of decreasing phase fraction. The number for ICSD compound or the Strukturbericht designation for the simple ordered compounds is given in parentheses. The compounds are the same for both the 18R-i $Mg_{59}X_8{}^LCu_6$ and 14H-i $Mg_{71}X_8{}^LCu_6$ compositions, unless indicated otherwise by a footnote. A negative stability indicates the LPSO structure is more stable than the convex hull phases.

| | 18R-i | | 14H-i | | |
|---|---|---|---|---|---|
| $X^L$ | $\Delta E_F$ | $\Delta E_{stab}$ | $\Delta E_F$ | $\Delta E_{stab}$ | Convex Hull Phases |
| Sc | −67 | −11 | −58 | −10 | Mg(A3/HCP),CuSc(B2),$Mg_3Sc(D0_{19})$ |
| Y | −84 | −7 | −73 | −7 | Mg(A3/HCP),$Mg_4CuY$(419475),$Mg_3Y(D0_3)$ |
| La | −72 | 28 | −62 | 27 | $Mg_{12}La$(168466),$Mg_2Cu$(659334),$Mg_3La(D0_3)$ |
| Ce | −70 | 29 | −61 | 28 | $Mg_{41}Ce_5$(621487),$Mg_2Cu$(659334),$Mg_3Ce(D0_3)$ |
| Pr | −73 | 22 | −63 | 22 | $Mg_{41}Pr_5$(642771),$Mg_2Cu$(659334),$Mg_3Pr$(104854) |
| Nd | −75 | 16 | −65 | 16 | $Mg_{41}Nd_5$(642680),$Mg_2Cu$(659334),$Mg_3Nd(D0_{22})$ |
| Pm | −77 | 6 | −67 | 4 | Mg(A3/HCP),$Mg_3Pm(D0_{22})$,$Mg_2Cu$(659334) |
| Sm | −77 | 5 | −67 | 5 | $Mg_{41}Sm_5$(642842),$Mg_2Cu$(659334),$Mg_3Sm(D0_{22})$ |
| Eu | −67 | 13 | −58 | 11 | Mg(A3/HCP),$Mg_2Eu$(412689),$Mg_2Cu$(659334) |
| Gd | −79 | −7 | −69 | −7 | Mg(A3/HCP),$Mg_3Gd(D0_3)$,$Mg_2Cu$(659334) |
| Tb | −79 | −6 | −69 | −7 | Mg(A3/HCP),$Mg_4CuTb$(418215),$Mg_3Tb(D0_3)$ |
| Dy | −79 | −15 | −69 | −14 | Mg(A3/HCP),$Mg_3Dy(D0_3)$,$Mg_2Cu$(659334) |
| Ho | −78 | −18 | −68 | −16 | Mg(A3/HCP),$Mg_3Ho(D0_3)$,$Mg_2Cu$(659334) |
| Er | −78 | −20 | −68 | −18 | $Mg_{24}Er_5$(109136),Mg(A3/HCP),$Mg_2Cu$(659334) |
| Tm | −76 | −21 | −66 | −19 | Mg(A3/HCP),CuTm(B2),$Mg_3Tm(D0_3)$ |
| Yb | −61 | 8 | −53 | 6 | Mg(A3/HCP),$Mg_2Yb$(104895),$Mg_2Cu$(659334) |
| Lu | −73 | −16 | −64 | −15 | Mg(A3/HCP),CuLu(B2),$Mg_{24}Lu_5$(642418) |
| Tl | −3 | 53 | −2 | 46 | Mg(A3/HCP),$Mg_3Tl(D0_{19})$,$Mg_2Cu$(659334) |

TABLE 10-continued

Formation energies and stabilities for the Mg-$X^L$-Cu LPSO structures, in meV/atom. The stable convex hull compounds is given in order of decreasing phase fraction. The number for ICSD compound or the Strukturbericht designation for the simple ordered compounds is given in parentheses. The compounds are the same for both the 18R-i $Mg_{59}X_8^LCu_6$ and 14H-i $Mg_{71}X_8^LCu_6$ compositions, unless indicated otherwise by a footnote. A negative stability indicates the LPSO structure is more stable than the convex hull phases.

| | 18R-i | | 14H-i | | |
|---|---|---|---|---|---|
| $X^L$ | $\Delta E_F$ | $\Delta E_{stab}$ | $\Delta E_F$ | $\Delta E_{stab}$ | Convex Hull Phases |
| Sb | −34 | 99 | −27 | 87 | Mg(A3/HCP),$Mg_3Sb_2$(2142),$Mg_2Cu$(659334) |
| Pb | −12 | 53 | −11 | 45 | Mg(A3/HCP),$Mg_3Pb(L1_2)$,$Mg_2Cu$(659334) |
| Na | 34 | 65 | 29 | 56 | Mg(A3/HCP),$Mg_2Cu$(659334),Na(C19) |
| Te | −50 | 179 | −42 | 154 | Mg(A3/HCP),$Mg_2Cu$(659334),MgTe(52363) |
| Bi | −24 | 73 | −19 | 64 | Mg(A3/HCP),$Mg_3Bi_2$(659569),$Mg_2Cu$(659334) |
| Pa | 67 | 98 | 56 | 83 | Mg(A3/HCP),$Mg_2Cu$(659334),Pa(A1/FCC) |
| Ca | −57 | 19 | −49 | 16 | Mg(A3/HCP),$CaMg_2$(165564),$Mg_2Cu$(659334) |
| Th | −35 | −4 | −31 | −4 | Mg(A3/HCP),$Mg_2Cu$(659334),Th(A1/FCC) |
| K | 89 | 120 | 79 | 106 | Mg(A3/HCP),$Mg_2Cu$(659334),K(A2/BCC) |
| Sr | −28 | 45 | −22 | 41 | $Mg_{23}Sr_6$(104876),Mg(A3/HCP),$Mg_2Cu$(659334) |

TABLE 11

Formation energies and stabilities for the Mg-XL-Co LPSO structures, in meV/atom. The stable convex hull compounds is given in order of decreasing phase fraction. The number for ICSD compound or the Strukturbericht designation for the simple ordered compounds is given in parentheses. The compounds are the same for both the 18R-i $Mg_{59}X_8^LCo_6$ and 14H-i $Mg_{71}X_8^LCo_6$ compositions, unless indicated otherwise by a footnote. A negative stability indicates the LPSO structure is more stable than the convex hull phases.

| | 18R-i | | 14H-i | | |
|---|---|---|---|---|---|
| $X^L$ | $\Delta E_F$ | $\Delta E_{stab}$ | $\Delta E_F$ | $\Delta E_{stab}$ | Convex Hull Phases |
| Sc | −63 | 6 | −54 | 6 | Mg(A3/HCP),CoSc(B2),$Mg_3Sc(D0_{19})$ |
| Y | −61 | −12 | −53 | −11 | Mg(A3/HCP),$Mg_3Y(D0_3)$,$Co_3Y$(625559) |
| La | −50 | 23 | −43 | 23 | $Mg_{12}La$(168466),$Mg_3La(D0_3)$,$Co_{13}La$(656879) |
| Ce | −37 | 36 | −33 | 33 | $Mg_{41}Ce_5$(621487),$Mg_{12}Ce$(621495),Co(A3/HCP)[a] |
| Pr | −43 | 25 | −38 | 23 | $Mg_{41}Pr_5$(642771),$Mg_{12}Pr$(104856),Co(A3/HCP)[b] |
| Nd | −47 | 16 | −42 | 13 | $Mg_{41}Nd_5$(642680),Co(A3/HCP),Mg(A3/HCP)[c] |
| Pm | −52 | 0 | −46 | −2 | Mg(A3/HCP),$Mg_3Pm(D0_{22})$,Co(A3/HCP) |
| Sm | −54 | 1 | −47 | 0 | $Mg_{41}Sm_5$(642842),Mg(A3/HCP),$Co_{17}Sm_2$(625233)[d] |
| Eu | 1 | 50 | 0 | 42 | Mg(A3/HCP),$Mg_2Eu$(412689),Co(A3/HCP) |
| Gd | −59 | −13 | −52 | −13 | Mg(A3/HCP),$Mg_3Gd(D0_3)$,$Co_{17}Gd_2$(623333) |
| Tb | −61 | −17 | −53 | −15 | Mg(A3/HCP),$Mg_3Tb(D0_3)$,$Co_2Tb$(152587) |
| Dy | −62 | −18 | −54 | −16 | Mg(A3/HCP),$Mg_3Dy(D0_3)$,$Co_2Dy$(163700) |
| Ho | −62 | −18 | −55 | −17 | Mg(A3/HCP),$Mg_3Ho(D0_3)$,$Co_2Ho$(108296) |
| Er | −63 | −18 | −55 | −17 | Mg(A3/HCP),$Mg_{24}Er_5$(109136),$Co_2Er$(622773) |
| Tm | −63 | −20 | −55 | −18 | Mg(A3/HCP),$Mg_3Tm(D0_3)$,$Co_2Tm$(625505) |
| Yb | 3 | 41 | 2 | 35 | Mg(A3/HCP),$Mg_2Yb$(104895),Co(A3/HCP) |
| Lu | −62 | −13 | −54 | −12 | Mg(A3/HCP),CoLu(B2),$CoLu_3$(624053) |
| Tl | 48 | 72 | 40 | 61 | Mg(A3/HCP),$Mg_3Tl(D0_{19})$,Co(A3/HCP) |
| Sb | −24 | 78 | −21 | 67 | Mg(A3/HCP),$Mg_3Sb_2$(2142),Co(A3/HCP) |
| Pb | 28 | 62 | 23 | 52 | Mg(A3/HCP),$Mg_3Pb(L1_2)$,Co(A3/HCP) |
| Na | 128 | 128 | 109 | 109 | Mg(A3/HCP),Na(C19),Co(A3/HCP) |
| Te | −18 | 180 | −15 | 155 | Mg(A3/HCP),MgTe(52363),Co(A3/HCP) |
| Bi | 2 | 67 | 2 | 58 | Mg(A3/HCP),$Mg_3Bi_2$(659569),Co(A3/HCP) |
| Pa | −25 | 12 | −18 | 13 | Mg(A3/HCP),$Co_3Pa(L1_2)$,Pa(A1/FCC) |
| Ca | 14 | 59 | 11 | 49 | Mg(A3/HCP),$CaMg_2$(165564),Co(A3/HCP) |
| Th | −69 | −6 | −60 | −6 | Mg(A3/HCP),CoTh(625442),$Co_3Th_7$(625455) |
| K | 184 | 184 | 159 | 159 | Mg(A3/HCP),K(A2/BCC),Co(A3/HCP) |
| Sr | 49 | 91 | 41 | 77 | Mg(A3/HCP),$Mg_{23}Sr_6$(104876),Co(A3/HCP) |

[a]18R-i: $Mg_{41}Ce_5$(621487),Co(A3/HCP),$Mg_3Ce(D0_3)$

[b]18R-i: $Mg_{41}Pr_5$(642771),Co(A3/HCP),$Mg_3Pr$(104854)

[c]18R-i: $Mg_{41}Nd_5$(642680),Co(A3/HCP),$Mg_3Nd(D0_{22})$

[d]18R-i: $Mg_{41}Sm_5$ (642842),$Co_{17}Sm_2$(625233),$Mg_3Sm(D0_{22})$

TABLE 12

Formation energies and stabilities for the Mg-XL-Ni LPSO structures, in meV/atom. The stable convex hull compounds is given in order of decreasing phase fraction. The number for ICSD compound or the Strukturbericht designation for the simple ordered compounds is given in parentheses. The compounds are the same for both the 18R-i $Mg_{59}X_8^LNi_6$ and 14H-i $Mg_{71}X_8^LNi_6$ compositions. A negative stability indicates the LPSO structure is more stable than the convex hull phases.

| | 18R-i | | 14H-i | | |
|---|---|---|---|---|---|
| $X^L$ | $\Delta E_F$ | $\Delta E_{stab}$ | $\Delta E_F$ | $\Delta E_{stab}$ | Convex Hull Phases |
| Sc | −106 | −12 | −91 | −10 | Mg(A3/HCP),NiSc(B2),$Mg_3Sc(D0_{19})$ |
| Y | −112 | −25 | −97 | −22 | Mg(A3/HCP),$Mg_3Y(D0_3)$,$Mg_2Ni$(30713) |
| La | −98 | 18 | −85 | 18 | $Mg_{12}La$(168466),$Mg_2Ni$(30713),$Mg_3La(D0_3)$ |
| Ce | −90 | 25 | −78 | 25 | $Mg_{41}Ce_5$(621487),$Mg_2Ni$(30713),$Mg_3Ce(D0_3)$ |
| Pr | −95 | 17 | −82 | 17 | $Mg_{41}Pr_5$(642771),$Mg_2Ni$(30713),$Mg_3Pr$(104854) |
| Nd | −99 | 8 | −85 | 10 | $Mg_{41}Nd_5$(642680),$Mg_2Ni$(30713),$Mg_3Nd(D0_{22})$ |
| Pm | −102 | −3 | −88 | −3 | Mg(A3/HCP),$Mg_3Pm(D0_{22})$,$Mg_2Ni$(30713) |
| Sm | −104 | −6 | −90 | −4 | $Mg_{41}Sm_5$(642842),$Mg_2Ni$(30713),$Mg_3Sm(D0_{22})$ |
| Eu | −71 | 25 | −62 | 21 | Mg(A3/HCP),$Mg_2Eu$(412689),$Mg_2Ni$(30713) |
| Gd | −109 | −19 | −94 | −17 | Mg(A3/HCP),$Mg_3Gd_2Ni_2$(421933),$Mg_3Gd(D0_3)$ |
| Tb | −110 | −18 | −95 | −16 | Mg(A3/HCP),$Mg_3Ni_2Tb_2$(240761),$Mg_3Tb(D0_3)$ |
| Dy | −111 | −27 | −96 | −24 | Mg(A3/HCP),DyNi(109242),$Mg_3Dy(D0_3)$ |
| Ho | −112 | −27 | −96 | −23 | Mg(A3/HCP),HoNi(106792),$Mg_3Ho(D0_3)$ |
| Er | −112 | −23 | −97 | −20 | Mg(A3/HCP),ErNi(630842),$Mg_{24}Er_5$(109136) |
| Tm | −111 | −22 | −96 | −19 | Mg(A3/HCP),NiTm(105428),$Mg_3Tm(D0_3)$ |
| Yb | −67 | 18 | −59 | 14 | Mg(A3/HCP),$Mg_2Yb$(104895),$Mg_2Ni$(30713) |
| Lu | −110 | −16 | −95 | −15 | Mg(A3/HCP),LuNi(642448),$Mg_{24}Lu_5$(642418) |
| Tl | −13 | 59 | −11 | 51 | Mg(A3/HCP),$Mg_3Tl(D0_{19})$,$Mg_2Ni$(30713) |
| Sb | −60 | 89 | −51 | 77 | Mg(A3/HCP),$Mg_3Sb_2$(2142),$Mg_2Ni$(30713) |
| Pb | −30 | 51 | −26 | 44 | Mg(A3/HCP),$Mg_3Pb(L1_2)$,$Mg_2Ni$(30713) |
| Na | 46 | 93 | 38 | 79 | Mg(A3/HCP),$Mg_2Ni$(30713),Na(C19) |
| Te | −67 | 178 | −56 | 154 | Mg(A3/HCP),$Mg_2Ni$(30713),MgTe(52363) |
| Bi | −45 | 68 | −39 | 58 | Mg(A3/HCP),$Mg_3Bi_2$(659569),$Mg_2Ni$(30713) |
| Pa | 9 | 56 | −10 | 31 | Mg(A3/HCP),$Mg_2Ni$(30713),Pa(A1/FCC) |
| Ca | −58 | 34 | −52 | 27 | Mg(A3/HCP),$CaMg_2$(165564),$Mg_2Ni$(30713) |
| Th | −89 | −13 | −77 | −12 | Mg(A3/HCP),NiTh(105403),$Ni_3Th_7$(105406) |
| K | 99 | 146 | 85 | 126 | Mg(A3/HCP),$Mg_2Ni$(30713),K(A2/BCC) |
| Sr | −26 | 64 | −23 | 54 | $Mg_{23}Sr_6$(104876),Mg(A3/HCP),$Mg_2Ni$(30713) |

Figure 5:
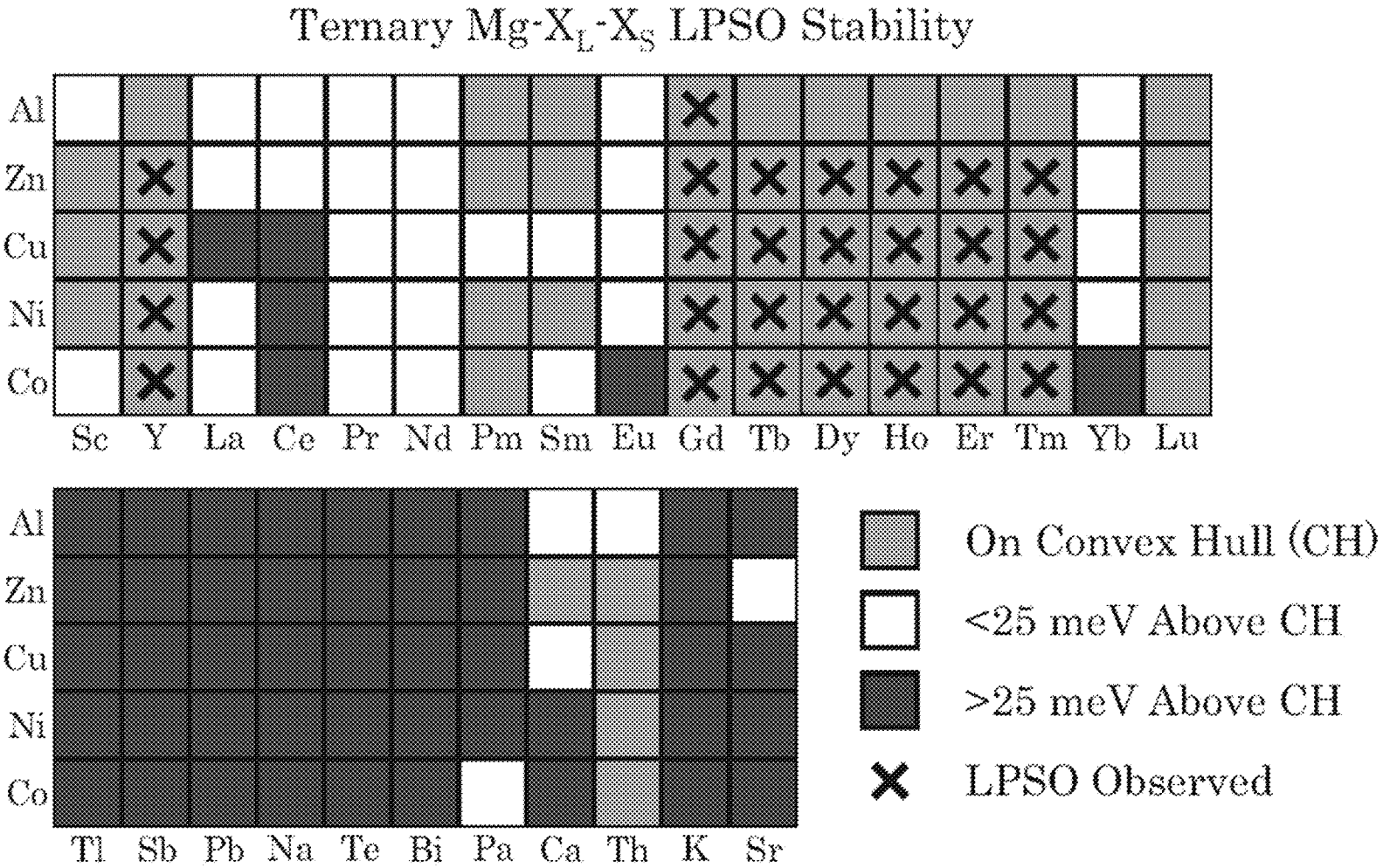
FIG. 5: DFT predicted stability of 14H-i and 18R-i LPSO structures for Mg—$X^L$—$X^S$ ternary systems. $X^S$ and $X^L$ elements are given along the vertical and horizontal axes, respectively. Color coding is defined by the values of $\Delta E_{stab}$ given in Tables 8-12: light gray for on the convex hull ($0<\Delta E_{stab}<0$), white for near the convex hull ($0<\Delta E_{stab}<25$ meV/atom), and dark gray for far from the convex hull (25 meV/atom$<\Delta E_{stab}$). $X^L$=RE systems are given in the top panel and $X^L\neq$RE systems are given in the bottom panel. Experimentally observed LPSO-forming systems are also indicated. Light grey squares without an "x" indicate systems where, as-yet-unobserved (to the best of the inventors' knowledge) LPSO phases were calculated to be stable.

The stability of LPSO structures in all Mg-RE-$X^S$ ternary systems explored in the current work is summarized in FIG. 5. Interestingly, regardless of which $X^S$ is present, the same set of heavier RE $X^L$ elements generally appear to form stable LPSO structures: Y, Gd, Tb, Dy, Ho, Er, Tm, and Lu. As indicated in FIG. 5, several other ternary systems, such as those containing Nd and Sm, are predicted to have nearly stable LPSO structures, lying less than 25 meV above the convex hull (kBT at room temperature). Currently, LPSO phases have only been studied in very few ternaries for $X^S$=Zn. Of the 85 Mg—$X^S$-RE systems explored with DFT here, 52 were predicted to have thermodynamically stable LPSO structures. Eleven of the LPSO-forming ternary systems have been reported in the literature and also were predicted in this work to contain stable LPSO structures. (See, K. Amiya, T. Ohsuna, A. Inoue, Materials Transactions 44 (2003) 2151-2156; M. Yamasaki, T. Anan, S. Yoshimoto, Y. Kawamura, Scripta Materialia 53 (2005) 799-803; Y. Kawamura, T. Kasahara, S. Izumi, M. Yamasaki, Scripta Materialia 55 (2006) 453-456; K. Yamada, Y. Okubo, M. Shiono, H. Watanabe, Materials Transactions 47 (2006) 1066-1070; Y. Kawamura, M. Yamasaki, Materials Transactions 48 (2007) 2986-2992; T. Itoi, K. Takahashi, H. Moriyama, M. Hirohashi, Scripta Materialia 59 (2008) 1155-1158; J. Nie, K. Ohishi, X. Gao, K. Hono, Acta Materialia 56 (2008) 6061-6076; H. Yokobayashi, K. Kishida, H. Inui, M. Yamasaki, Y. Kawamura, Acta Materialia 59 (2011) 7287-7299; S.-B. Mi, Q.-Q. Jin, Scripta Materialia 68 (2013) 635-638; Q.-Q. Jin, C.-F. Fang, S.-B. Mi, Journal of Alloys and Compounds 7 (2013) and Z. Leng, J. Zhang, T. Yin, L. Zhang, S. Liu, M. Zhang, R. Wu, Materials Science and Engineering: A In Press (2013).) Therefore, the existence of new, as-yet-unobserved LPSO-forming ternary systems has been discussed by this work.

Thermodynamic Stability of Non-RE LPSO Structures

Non-RE $X^L$ elements are highly desirable to reduce the cost of employing LPSO precipitate strengthening on an industrial scale. To predict with DFT every possible Mg—$X^L$—$X^S$ system is prohibitively expensive given the large quantity of possible ternary systems. Therefore, the current DFT exploration of non-RE LPSO systems explored the five known $X^S$ elements and employed a simple screen (detailed below) on all possible $X^L$ elements with high-throughput DFT calculations that are less computationally more efficient than full calculations of LPSO stability. The set of promising $X^L$ elements which passed this screen was sufficiently small for DFT predictions of stability to be performed.

Candidate $X^L$ elements for LPSO formation were screened with an important factor contributing to the ability of an $X^L$ element to form a stable LPSO structure: the size mismatch of the element relative to Mg, using the mismatch between elemental atomic radii. From the DFT predicted atomic radii (calculated by taking half the nearest neighbor distance in the 0K ground state crystal structure), the atomic radius mismatch of the observed $X^L$ elements (Y and the later REs, as given in FIG. 5) ranged between 8.5-12% larger than Mg. After calculating this quantity for 88 elements, only three had radius mismatches near this range: Pb, Tl, and Th. The stability of LPSO structures for these elements serving as $X^L$ was predicted with DFT. Shown in FIGS. 6 and 5 and given in Tables 8-12, the stabilities for the Pb- and Tl-containing LPSO structures were very positive, indicating they will not form LPSO structures. Th-containing LPSO structures, on the other hand, were predicted to be stable.

Figure 6:
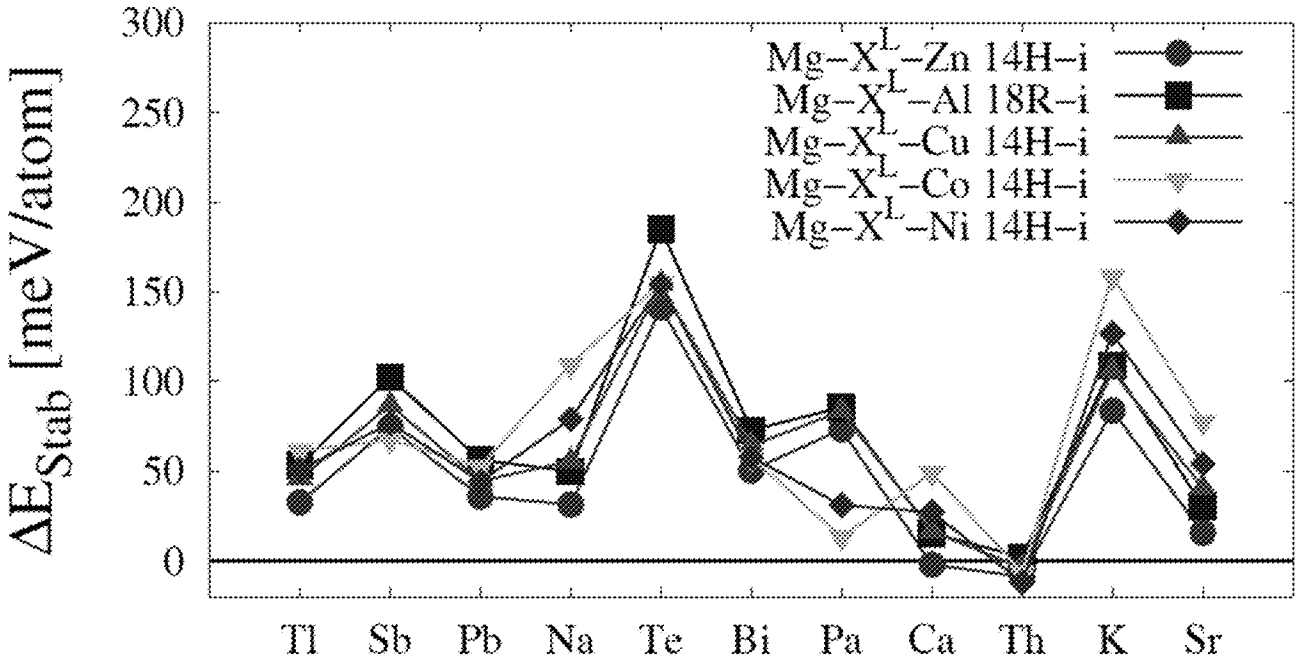
FIG. 6: DFT predicted relative stability of the indicated LPSO structure with respect to the lowest energy combination of all phases known from the ICSD and prototypes database in their respective ternary systems, $\Delta E_{stab}$. Negative values indicate the LPSO structure is thermodynamically stable. The sets of stable phases at the LPSO compositions can be found in Tables 8-12. Elements are ordered in increasing impurity volume in Mg.

$V_{Imp}^{X^L}$ was found to be a better indicator of the Mg/$X^L$ size mismatch towards LPSO stability with the impurity volume. This quantity is defined by:

$$V_{Imp}^{X^L} = V(Mg_{149}X_1) - V(Mg_{150}) \quad (9)$$

where $V(Mg_{150})$ and $V(Mg_{149}X_1)$ are the volumes of a 150 atom HCP supercell containing $Mg_{150}$ and $Mg_{149}X$, respectively. The impurity volume of $X^L$ in Mg captures the interaction of the alloying element with the Mg matrix. The DFT impurity volume was calculated for every element with a VASP potential. $V_{Imp}^{X^L}$, as an LPSO-forming criteria, clusters all the known $X^L$ elements (Y and the later REs, as given in FIG. 5) into a single group (between 11.1 and 14.6 $Å^3$). Therefore, DFT predicted the LPSO stability of several non-RE solutes with impurity volumes near RE values, specifically K, Sr, Ca, Na, Sb, Pb, Bi, and Pa. These stabilities are shown in FIG. 6 and given in Tables 8-12. Most of these LPSO structures were found to be metastable, but some came energetically close to the T=OK ground state convex hull, as shown in FIG. 5, particularly Ca- and Sr containing systems. In these systems, finite-temperature effects could stabilize LPSO structures.

Testing Proposed Design Rules for LPSO Stability

Kawamura et al. observed several trends amongst LPSO-forming $X^L$ elements: (1) $X^L$ is larger than Mg, (2) the mixing enthalpy between Mg/$X^L$ and $X^L$/$X^S$ is favorable, (3) $X^L$ has the HCP structure at room temperature, and (4) $X^L$ is moderately soluble in Mg. (See, Y. Kawamura, M. Yamasaki, Materials Transactions 48 (2007) 2986-2992.) The first trend was used as the screening criteria for choosing non-RE elements. With the DFT calculated energetics database of LPSO structures in 85 RE- and 50 non-RE-containing ternary systems, the remaining trends could be examined more closely and used to elucidate why RE $X^L$ elements form stable LPSO structure whereas others do not.

The second proposed trend is that the Mg—$X^L$ and $X^L$—$X^S$ binary systems exhibit favorable mixing thermodynamics. The favorable interactions between these elements may promote the formation of the LPSO, as Mg—$X^L$ and $X^L$—$X^S$ nearest neighbor bonds are present in the binary and ternary layers of the LPSO structure. DFT calculations of the formation energies of simple ordered compounds can estimate binary interactions for a particular lattice. As the $X^L$ atoms bond with Mg and $X^S$ on both HCP and FCC lattices in the LPSO structure, $L1_2$ and $D0_{19}$ formation energies for many possible Mg—$X^L$ and $X^L$—$X^S$ systems were calculated with DFT. The $Mg_3X$ $L1_2$ formation energy, $\Delta E_F^{Mg_3X}$, appeared to be the best indicator for whether an $X^L$ element can contribute to a stable LPSO structure, by clustering observed $X^L$ elements (Y and the later REs, as given in FIG. 5) with similar values. All observed $X^L$ elements have negative $Mg_3X$ $L1_2$ formation energies, between −34 and −76 meV/atom.

Interestingly, either $\Delta E_F^{Mg_3X}$ or $V_{Imp}^{X^L}$ alone were not sufficient indicators of whether an $X^L$ element would form a stable LPSO structure. For instance, Pb is predicted to have formation energies in the range of the observed $X^L$ elements, but, from FIG. 6, Pb forms metastable LPSO structures. Pb has a smaller impurity volume than the observed RE $X^L$ elements. Pa, conversely, has an impurity volume similar to the observed $X^L$ elements but has a very unfavorable mixing energy, also resulting in metastable LPSO structures. Of all the non-RE elements studied in this work, Ca was nearest to satisfying both constraints, perhaps explaining why Ca-containing LPSO structures are predicted to have competitive stabilities. Therefore, it was found that the impurity volume and $X^L$—Mg FCC mixing energy together served as excellent criteria for determining LPSO formation, including, within a certain range, all stable $X^L$ elements and excluding all others. The heavy RE elements are unique in that they satisfy both criteria.

The remaining two trends of Kawamura et al. can be explored from direct experimental observations. The third trend is that all known $X^L$ elements appear to be HCP at room temperature. Every HCP RE element has been found to form LPSO structures, except for Sc and Lu, which have not been explored. From the DFT results, it was predicted that Sc- and Lu containing LPSO structures were stable. Non-RE HCP elements include Be, Ti, Zr, Tc, Ru, Hf, Re, Os, and Tl. From the predictions of the impurity volume, these elements are all smaller than Mg, except for Tl, which is only slightly larger than Mg. With an impurity volume about 90% smaller than the values for the observed $X^L$ elements, Tl was predicted to form metastable LPSO structures (see FIG. 6). This result shows that there are no non-RE HCP elements that also have impurity volumes in the range of the RE elements. Ca, Sr, and Th, which are the promising LPSO forming $X^L$ elements discussed earlier, are not HCP. However, DFT calculations of HCP Ca and Sr predict it to be very close energetically to FCC Ca and Sr (within 5 meV/atom or less). (See, J. Saal, S. Kirklin, B. Meredig, A. Thompson, J. Doak, C. Wolverton Under Prep (2013) and Y. Wang, S. Curtarolo, C. Jiang, R. Arroyave, T. Wang, G. Ceder, L. Q. Chen, Z. K. Liu, Calphad 28 (2004) 79-90.) The fourth trend is that some moderate degree of solubility of $X^L$ in Mg is present. From the observed $X^L$ elements, the solubility at the eutectic temperature varies between 3.4 and 6.9 at. %. The solubility of Ag lies in this range, but the impurity volume of Ag is negative. Again, Ca and Th do not satisfy these conditions, exhibiting solubilities of 0.44 and 0.52 at. %, respectively.

Ultimately, of the 11 non-RE $X^L$ elements studied in this work, only Ca, Sr, Pa and Th were found to form low-energy stable and/or metastable structures competitive with the thermodynamic ground state.

The word "illustrative" is used herein to mean serving as an example, instance, or illustration. Any aspect or design described herein as "illustrative" is not necessarily to be construed as preferred or advantageous over other aspects or designs. Further, for the purposes of this disclosure and unless otherwise specified, "a" or "an" means "one or more".

The foregoing description of illustrative embodiments of the invention has been presented for purposes of illustration and of description. It is not intended to be exhaustive or to limit the invention to the precise form disclosed, and modifications and variations are possible in light of the above teachings or may be acquired from practice of the invention. The embodiments were chosen and described in order to explain the principles of the invention and as practical applications of the invention to enable one skilled in the art to utilize the invention in various embodiments and with various modifications as suited to the particular use contemplated. It is intended that the scope of the invention be defined by the claims appended hereto and their equivalents.

What is claimed is:

1. A magnesium alloy comprising a long period stacking order structural phase having a 14H-i structure with a $Mg_{71}X^L{}_8X^S{}_6$ composition that includes Mg at an interstitial site or having a 18R-i structure with a $Mg_{59}X^L{}_8X^S{}_6$ composition that includes Mg at an interstitial site, wherein the stable 14H-i and the 18R-i structures have negative formation energies and are more stable than any combination of every other phase in their ternary system, wherein $X^L$ comprises a rare earth alloying element selected from Sc, Y, Pm, Sm, Tb, Dy, Ho, Er, Tm, and Lu and $X^S$ comprises a second alloying element selected from Al, Zn, Cu, Ni, and Co, and further wherein if $X^s$ is Al, $X^L$ is Y, Pm, Sm, Tb, Dy, Ho, Er, Tm or Lu; if is $X^s$ is Zn, $X^L$ is Sc, Pm, Sm or Lu; if $X^s$ is Cu, $X^L$ is Sc or Lu; if $X^s$ is Ni, $X^L$ is Sc, Pm, Sm or Lu; and if $X^s$ is Co, $X^L$ is Pm or Lu.

2. The magnesium alloy of claim 1, wherein $X^s$ is Al and $X^L$ is Y, Pm, Sm, Tb, Dy, Ho, Er, Tm or Lu.

3. The magnesium alloy of claim 1, wherein $X^s$ is Zn, Cu, or Ni and $X^L$ is Sc.

4. The magnesium alloy of claim 1, wherein $X^s$ is Al, Zn, Ni, or Co and $X^L$ is Pm.

5. The magnesium alloy of claim 1, wherein $X^s$ is Al, Zn, or Ni and $X^L$ is Sm.

6. The magnesium alloy of claim 1, wherein $X^s$ is Al, Zn, Cu, Ni, or Co and $X^L$ is Lu.

* * * * *